US007452652B2

(12) United States Patent
Detig

(10) Patent No.: US 7,452,652 B2
(45) Date of Patent: Nov. 18, 2008

(54) LIQUID TONERS FOR ELECTROSTATIC PRINTING OF FUNCTIONAL MATERIALS

(76) Inventor: Robert H. Detig, 185 Union Ave., New Providence, NJ (US) 07974

( * ) Notice: Subject to any disclaimer, the term of this patent is extended or adjusted under 35 U.S.C. 154(b) by 241 days.

(21) Appl. No.: 11/019,742

(22) Filed: Dec. 22, 2004

(65) Prior Publication Data

US 2005/0100810 A1 May 12, 2005

Related U.S. Application Data

(60) Continuation-in-part of application No. 10/453,111, filed on Jun. 3, 2003, now Pat. No. 6,876,370, which is a division of application No. 09/786,030, filed as application No. PCT/US99/23612 on Oct. 12, 1999.

(60) Provisional application No. 60/104,079, filed on Oct. 13, 1998.

(51) Int. Cl.
*G03G 9/12* (2006.01)

(52) U.S. Cl. ..... 430/114; 430/117; 430/137.11; 430/137.12

(58) Field of Classification Search ..... 430/114, 430/117, 137.11, 137.12
See application file for complete search history.

(56) References Cited

U.S. PATENT DOCUMENTS

| | | | | |
|---|---|---|---|---|
| 3,286,025 | A | 11/1966 | Ingersoll | |
| 3,900,412 | A | 8/1975 | Kossel | |
| 3,909,433 | A * | 9/1975 | Gilliams et al. | 430/114 |
| 4,161,453 | A * | 7/1979 | Gilliams et al. | 430/115 |
| 4,181,620 | A * | 1/1980 | Tsubuko | 430/114 |
| 4,473,630 | A * | 9/1984 | Yokoya et al. | 430/114 |
| 4,732,831 | A | 3/1988 | Riesenfeld et al. | |
| 4,786,576 | A | 11/1988 | Bujese et al. | |
| 4,879,184 | A | 11/1989 | Bujese et al. | |
| 5,051,247 | A * | 9/1991 | Bokerman et al. | 423/342 |
| 5,066,559 | A * | 11/1991 | Elmasry et al. | 430/115 |
| 5,272,034 | A * | 12/1993 | Kawano et al. | 430/137.21 |
| 5,273,854 | A * | 12/1993 | Shinozuka et al. | 430/114 |
| 5,604,070 | A * | 2/1997 | Rao et al. | 430/108.22 |
| 6,337,168 | B1 * | 1/2002 | Almog | 430/114 |

FOREIGN PATENT DOCUMENTS

JP 62097651 * 5/1987

OTHER PUBLICATIONS

Abstract of JP-62097651, May 7, 1987.*

* cited by examiner

*Primary Examiner*—Hoa V Le
(74) *Attorney, Agent, or Firm*—Fox Rothschild LLP

(57) ABSTRACT

Liquid toners suitable for use in the electrostatic printing of functional materials to produce microstructures such as ribs, electrodes, spacers or filters, and methods of producing the liquid toners. The functional materials, which may include metals, glass and phosphors, are suspended as particles in a dilutent, which may be a non-polar liquid. The surface, or portions of the surface, of the functional material particles are given an appropriate acidic or hydroxyl functionality necessary for their use in electrostatic imaging either by etching or by coating with a material having the appropriate surface functionality.

10 Claims, 16 Drawing Sheets

EXPOSE

CHARGING

DELAY

LIQUID TONER
DEVELOPMENT

LIQUID TONERS FOR ELECTROSTATIC PRINTING OF FUNCTIONAL MATERIALS

CROSS REFERENCE TO RELATED APPLICATIONS

This application is a continuation-in-part of application Ser. No. 10/453,111, filed on Jun. 3, 2003, which is a divisional of application Ser. No. 09/786,030, filed on Feb. 28, 2001 as a 371 of international application PCT/US99/23612, filed on Oct. 12, 1999, and which issued as U.S. Pat. No. 6,781,612 on Aug. 24, 2004 and which claims priority from U.S. Provisional Patent Application Ser. No. 60/104,079 filed Oct. 13, 1998, the entire contents and subject matter of all of which are hereby incorporated in total by reference.

FIELD OF THE INVENTION

The present invention applies to liquid toners, and particularly to liquid toners for use in electrostatic printing.

BACKGROUND OF THE INVENTION

Flat panel displays or wall type television sets have been discussed in the prior art literature for about forty years, but few have been produced. As of mid 1998 there were three primary flat panel technologies for flat panel displays:

A. Field Emission Displays (FED's.)

B. Plasma Displays

C. Active Matrix Liquid Crystal Displays (AMLCD)

Field emission displays are a relatively new technology. They consist of an array of field emission points in a vacuum, spraying electrons onto a phosphor screen. With three color dots on the screen and addressibility of the emitting points, one has a full color display.

The Plasma displays have been produced for about 25 years, mostly as a single color orange neon "glow discharge". In the last 10 years, UV light from this discharge has been "harnessed" to excite three color phosphors to produce a color plasma displays. 40" diagonal displays have been recently announced, but their cost is about $10,000.

Active matrix liquid crystal displays have been intensively developed for production. Billions of dollars have been spent on their development over the last 20 years, but the results have been only an expensive small display (10.4 inch diagonal) for lap top computers. The 1996 cost of a 10.4" display is about $500. Wall type TV units, 20" diagonal or so, are perhaps available after the year 2000, but very expensive.

The reason for the small size/high cost of production are the currently used manufacturing techniques. These include:

A. Photolithography or the patterning of photo sensitive resists and the "washing" and etching processes that are attendant to them.

B. Silk screen printing of relatively large area features (30μ or more).

C. Low pressure sputtering processes for coating glasses with metals like aluminum or indium/tin oxide (ITO), a transparent electrode or dielectrics like $SiO_2$.

In all cases the process has many steps, many in which the glass has to be heated and then cooled back to room temperature before the next step. Each of these steps requires a large piece of capital equipment in a class 100 clean room whose capital cost is $500 per square foot for the room itself. The capital equipment runs the gamut from a $40,000 liquid etcher, or developer, to a $2.5M stepper to a $4M sputtering cluster (six to eight vacuum chambers that accept 1 m×1 m glass).

There is "suite" of expensive capital equipment in a typical $500 per square foot clean room so that the cost of a modern AMLCD production facility is approximately $500 Million. None of the raw materials for the displays, including the glass, glass powder or frit, phosphor, aluminum or nickel, resin or color filter resins are very expensive. Costs are incurred by the capital equipment and low yield of a complex process with many steps.

What is needed is a simpler manufacturing process with fewer steps that requires less capital equipment, does not involve heating and cooling within the imaging step as this dimensionally distorts the glass substrate by thermal expansion, and is implementable with relatively inexpensive machinery, i.e. no vacuum chambers, laser exposure steps etc.

Electrostatic printing has been used for color proofing in Du Ponts EMP process during the late 1980's. Du Pont used the electrostatic printing which is described by Reisenfield in U.S. Pat. No. 4,732,831. It used liquid toners that were transferred directly to a smooth, coated sheet of paper.

The transfer of liquid toner, which is important to this invention, was disclosed by Bujese in U.S. Pat. No. 4,879,184 and U.S. Pat. No. 4,786,576. These documents teach the transfer of liquid toners across a finite mechanical gap, typically 50μ to 150μ. This technology has been applied where toner, with etch resist properties, was transferred to copper clad glass epoxy boards.

Other prior work related to the printing plate and "gap transfer" includes M. B. Culhane (Defensive Publication# T869004, Dec. 16, 1969) and Ingersol and Beckmore to the electrostatic printing plate (U.S. Pat. No. 3,286,025 and RE No. 29,357; RE No. 29,537 respectively).

SUMMARY OF THE INVENTION

Briefly described, the present invention teaches liquid toners containing functional materials that enable the electrostatic printing of those functional materials onto glass to produce various "microstructures" like ribs or electrodes, spacers, filters etc. by a copy machine type of device at rates from 0.1 to 1.0 m/sec, and methods of producing those toners.

In some cases there is a later step of sintering or electroless plating, but this is "after the fact" in that dimensional accuracy was previously determined by the printing step done at room temperature using the liquid toners of this invention. The functional materials may include, but are not limited to, metals, dielectrics, phosphors, and catalytic seed materials.

Since the substrate material onto which the liquid toners are typically printed is glass having the following properties:

1. It is mechanically of irregular shape (i.e. it is wedge shaped in orthogonal directions and its thickness has considerable variation); and, 2. It is a very thick material to be electrostatically imaged compared to the paper or polymeric films printed on by copiers or laser printers.

For this reason the liquid toners comprised of function materials of this invention need to be capable of being electrostatically transferred across a significant mechanical fluid filled gap.

While the "gap transfer" technique just described is useful in production machinery handling 1.0 m by 1.4 m plates, there are many situations where the printing capability on a relieved surfaced is a significant advantage, and the magnitude of surface relief can be quite substantial, of the order of 0.1 mm or 100μ or more.

The electrostatic printing function using the functional particle liquid toners is typically done in one process step. Afterwards the particulate mass formed by the transferred functional material is fused into a solid structure with a subsequent heating step. In one embodiment of the invention, the toners are catalytic seed toners that are printed on the glass and metals like copper, or nickel, are then deposited on the glass at the position of the catalytic seed toner by "electroless" plating.

Finally, there are toners that can be used on certain partially manufactured products like color filters or CRT face plates in a process wherein the final part plays the role of using a printing plate to print on itself. This is very simple and therefore inexpensive process which contains a "self-healing" feature. Imperfections in the semi finished parts are automatically overprinted with the liquid toner.

These and other features of the invention will be more fully understood by references to the following drawings.

DETAILED DESCRIPTION

Figure 1:
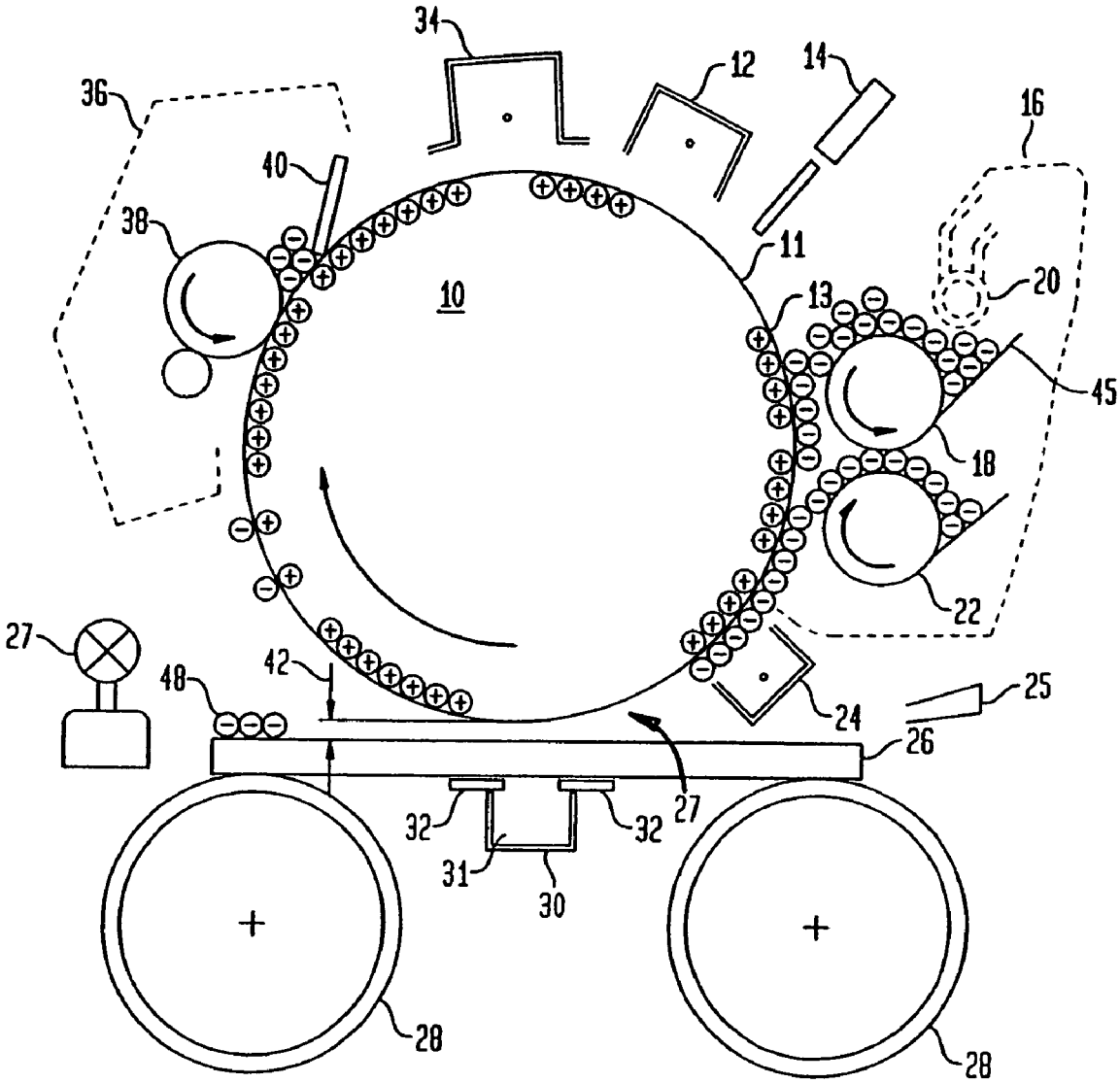
FIG. 1 illustrates an overall mechanical system using the toner of the invention.

During the course of this description, like numbers will be used to identify like elements according to the different views which illustrate the invention.

The present invention relates to liquid toners that contain functional particles that can be used to form a structure through electrostatic imaging or printing. The functional material may, for instance, be a metal electrostatically printed to form electrodes or other metal structures on a glass or other surface. In order to be usable in an electrostatic printing apparatus of the types described in detail below, the surface of the toner's functional particle needs to have either an acidic or hydroxyl functionality. Acidic surfaces are surfaces that are capable of losing a hydrogen ion, leaving a negative charge on the toner particle, while hydroxyl surfaces are those that are capable of losing an OH group, leaving a positive charge on the toner particle. Typically datasheets on resins refer to their acid number or hydroxyl number which expresses this functionality. Normally one wants a resin with a high acidic number or conversely a high hydroxyl number.

If the functional material is somewhat "neutral" in its acid/base functionality as are, for instance, glass, pure aluminum, palladium, or phosphors such as zincsulfide or europium oxide, it cannot be used in electrostatic printing without some modification. In a preferred embodiment, the solution is to coat the functional particle with a material that will provide the appropriate acid/base functionality, and so create a toner particle that can be used in the printing systems detailed below. This coating may for instance consist of a polymer coating, in which the polymer is chosen or designed to have the appropriate acid or base functionality. In a preferred embodiment, the coating consists of an organosol resin such as those described by Kosel in U.S. Pat. No. 3,900,412, the contents of which are hereby incorporated by reference. Such resinous material may be applied by a number of means including, but not limited to, spray drying, mechanical impaction and in-situ polymerization, where polymeric material of one morphology is coated with polymeric material of another morphic form.

In a further embodiment, the surface coating can comprise the surface of the original functional material which has been altered to provide the required acid or base functionality. For instance, creating the surface coating may consist of a simple surface treatment such as etching the functional particles in an acidic or basic solution leaving H ions or OH groups on the surface of the metal.

The coating need not be continuous as a partial coating may generate sufficient electrochemical charge for proper imaging.

In a preferred embodiment of the invention, the function toner is produced by coating the functional particle with an insitu polymerized resin by means of mechanical impaction. This may be done by, for instance, combining organasol resin particles and the required functional particles with an appropriate dilutent and milling media in a high-sheer mill. The combined ingredient may then be milled for a period of time that is sufficient to adequately coat the functional particles. Examples of producing functional toners by this means are detailed below.

FIG. 1 shows an overall mechanical schematic of a system designed to use liquid toner of the preferred embodiment. Drum 10 has a latent electrostatic image 13 on its surface 11. It is charged by sensitizing corona 12. If it is a photo sensitive surface it is exposed in an image wise fashion by LED/strip lens assembly 14. Alternately it could compose an electrostatic printing plate as disclosed by Reisenfeld of U.S. Pat. No. 4,732,831 where the image areas retain charge and the background areas discharge before the drum 10 rotates to the developer unit 16. The unit 16 is comprised of toner developer roller 18 that is splashed with liquid toner by pipe 20. The developer roller 18 rotates in such a manner as to move in the same direction of the drum but typically at a relative velocity of 1.5 times. Reverse roller 22 rotates in a manner opposite the drum 10 and with a relative velocity of 3 times. The purpose of this reverse roller 22 is to scavenge excess toner liquid off the image surface 11 which also controls unwanted background. A corona unit 24 at roughly the 5 o'clock position serves to "compact" the toner image before transfer. This is also referred to as "depress" corona.

Glass plate 26, which is pre-wetted with toner diluent, moves from right to left. It rests on insulating rollers 28 which are spaced with respect to the drum surface 11 to provide a nominal gap 42 between the glass surface 26 and the drum surface 11. Means are used to "float" either the image drum 10 with respect to the glass surface 26 or the glass surface 26 with respect to the drum 10, or glass 26, these are well known to those skilled in the mechanical arts. Corona unit 30 charges the bottom surfaces of the glass 26. Wire 31 is raised to about 7 kilovolts grounded mechanical shutters 32 are adjustable to charge the glass 26 at the proper desired location to achieve optimum toner transfer. Corona unit 34 is an AC corona discharge to discharge the drum 10 before cleaning. Alternately this unit, or a second AC corona, may be located after cleaning unit 36. This first AC corona is not shown.

Cleaning unit 36 typically consists of a squeegee roller 38 that does bulk, rough removal of residual toner, while wiper blade 40 does the final, complete cleaning of the drum surface 11. The drum 10 is now ready for the next image. Excess liquid 51 can be removed by any means, e.g., blown dry with air 27.

Figure 2:
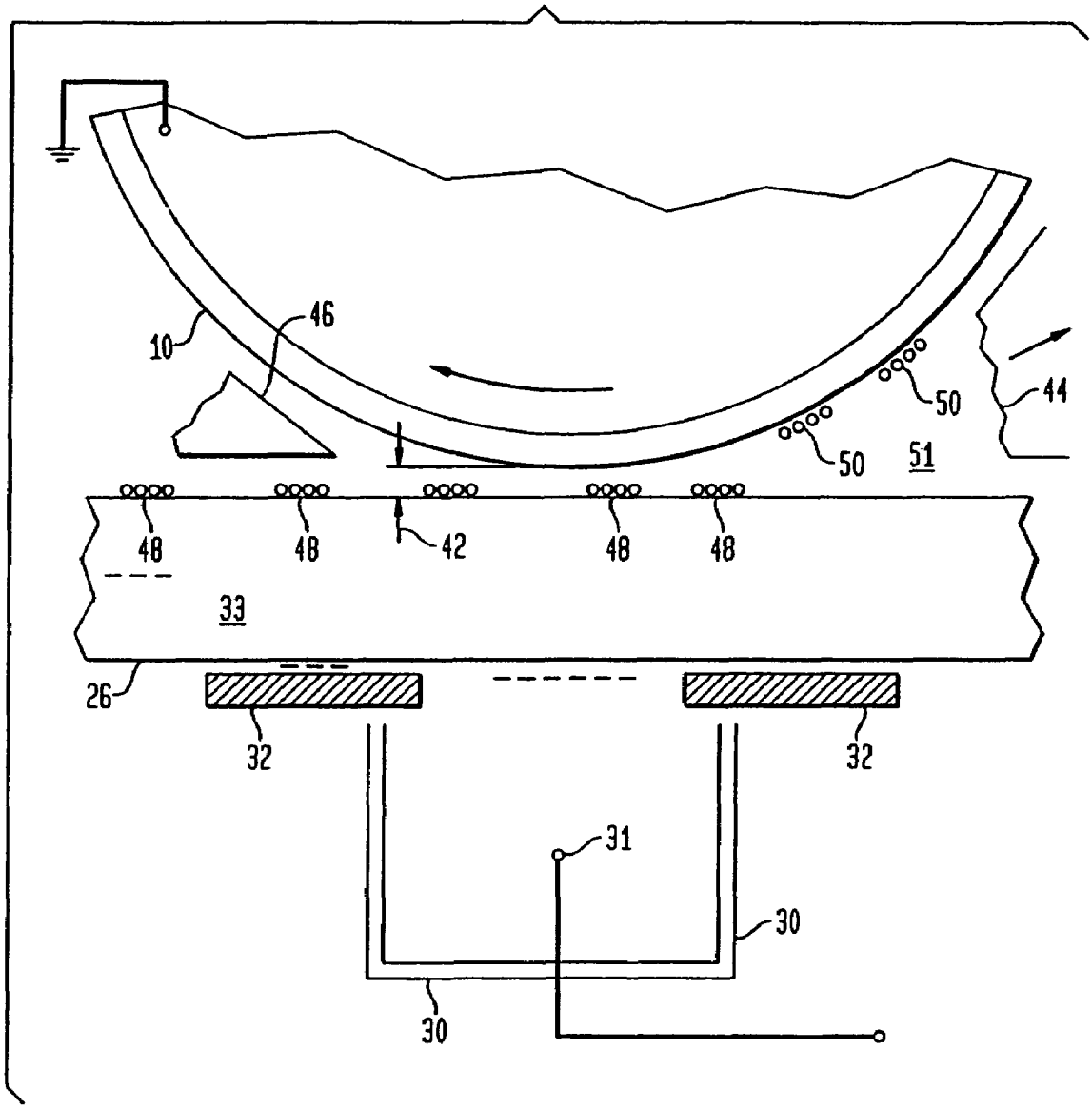
FIG. 2 illustrates a detailed view of the nip between drum and glass.

Important details of the system are revealed by FIG. 2. Here is shown an enlarged view of the drum 10, gap 42, glass structure 26 at the transfer point, nominally at 6 o'clock. The drum 10 is wet with liquid toner 50 and residual diluent 51 coming into the nip formed by drum 10 and glass 26. The glass is pre-wetted with clear diluent to ensure that the gap between drum and glass is filled with liquid. Metering of liquid on the drum and the pre-wetting liquid on the glass is not very precise so a wave of excessive liquid builds up to form a wave front 44 in the input to the nip. This is referred to, herein, as the Tsunami effect. The toner on the drum before transfer 50 needs to transfer to the glass in a location of low turbulence, about 6 o'clock.

Alternately on the output end, the amount of liquid between drum and glass is precisely determined by the gap which is between 50μ to 150μ and can be easily controlled to +/−5μ with the "floating" techniques mentioned previously. Therefore a "film splitting" occurred as shown in FIG. 2 not necessarily 50%/50% as suggested by this drawing. Actual values will depend on the surface energy of the drum surface (amorphous selenium or silicon or alternately a photopolymer) versus that of the glass. For the purposes of this invention the film splitting point 46 is precisely defined and unchanging for particular materials and one gap setting while the wave front of excessive liquid 44 is highly unstable and moves to the right from the beginning of the glass sheet to its end and can become quite violent and turbulent.

Important features of this are now evident:

First: the actual transfer electric fields can be quite large as typical soda lime glass has substantial electrical conductivity (as much as $10^{-10}$ mho/cm) so the corona charge migrates through the glass to near the transfer point. As the drum and glass surface start moving away for each other very high electric fields can be generated.

Second: By moving the location of the corona and the shutters laterally, the exact location of the transfer "zone" can be moved with respect to the wave 44 and exit film splitting point 46. U.S. Pat. No. 4,849,784 by Blanchet-Fincher teaches the importance of not attempting gap transfer in the turbulence of the input wave.

Third: After transfer, toner particles 48 are tightly bound to the surface of the glass by the internal transfer charges from the transfer corona 30. This prevents them from being smeared by random motion of residual diluent liquids on the glass before the toner is dried. Alternately if toner is transferred to a metal surface it is held to that surface by its "image" charge "seen" in the metal. This is classical electrostatic theory. Typically these "image" forces are significantly smaller than the strong binding forces between surface toner and the nearby transfer charges.

Other important features of this invention are the ability to print very large substrates, one meter by one meter or more with very small "features" (i.e. the dimensions of the image elements) and with very high levels of "overlay" accuracy (i.e. the registration of features) on one layer (or printing step) to overlay accurately the features on subsequent layers (or printing steps).

Figure 3A:
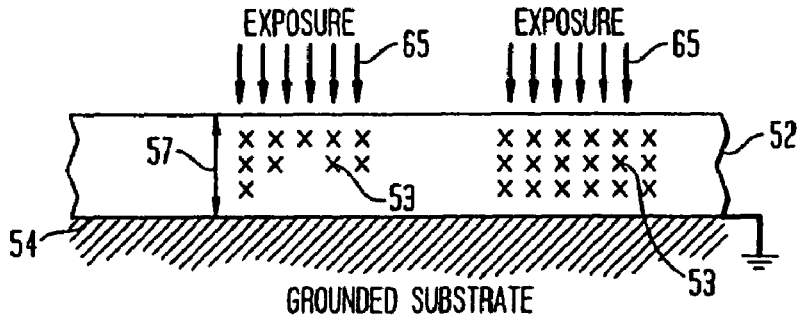
FIGS. 3*a-d* illustrate the electrostatic printing plate and the four steps in the imaging process.
Figure 3B:
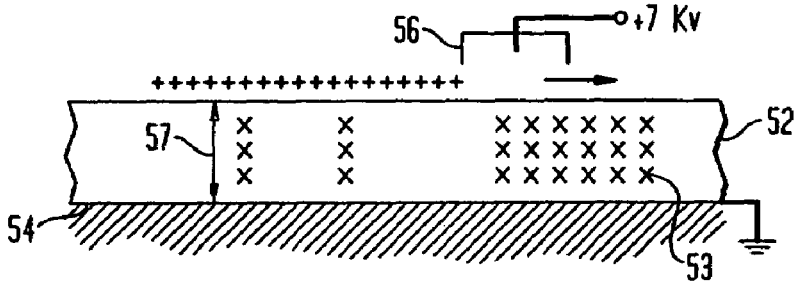
Figure 3C:
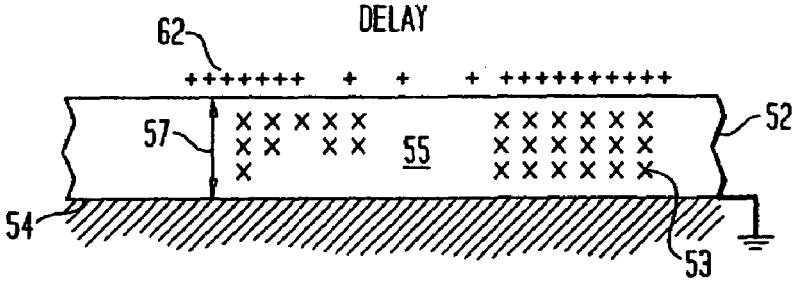
Figure 3D:
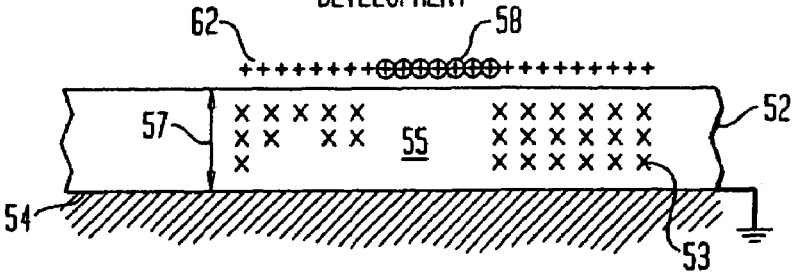

The electrostatic printing plate is shown in FIG. 3*a* is a photopolymer layer 52 bonded to an electrically grounded substrate 54. A photopolymer layer 52 is heat and pressure laminated to a grounded substrate, typically an aluminized polyester film (PET). It is then exposed through a contact photo tool to actinic radiation 60 (350 nm to 440 nm wavelength) to cross link the exposed areas. In FIG. 3*b* the plate is charged by a corona unit 56. The cross linked areas are much higher in electrical resistivity than normal photopolymer so they store charge for significant periods of time. After a suitable delay to allow the normal photopolymer to discharge 55, we have a latent image 62 on the printing plate as in FIG. 3*c*. In FIG. 3*d* a "reversal" development is effected with a liquid toner 58, i.e. development of the discharged areas of the plate (those referred to as normal photopolymer or not cross linked). Note the process can be a "normal" image, where the charged areas are developed or reversed as previously mentioned.

The Electrostatic Printing Plate can be film coated from a liquid solution which can be dried and partially hardened by a gentle bake. Coating methods include roller coating, spray coating, spin coating, dip coating or meniscus coating. Useful liquid photopolymers are usually negatively acting ones, those that cross link and that are insoluble in hydrocarbons or at least not significantly swelled by them. Typical examples of commercially available liquid materials are: Hoechst AZ-5200 IR, and MacDermid HDI-1, 2 or 3, also Mac Dermid. MT-1400. The dry film photopolymers are precast films than can be heat and pressure laminated to suitable substrates. They include these materials:

| | |
|---|---|
| DynaChem ® | AX 1.0 or 1.5<br>UF 0.5 or 1.0<br>5032, 5038, 5050 |
| MacDermid ® | SF-206<br>CF-1.3 |
| DuPont Riston ® | 9512<br>4615 |

The liquid resists can range in thickness from a fraction of a micron to about 15μ to 20μ depending on the coating technique used. They are typically in the fractional to 15μ range. The dry film resists tend to be much thicker in the 13μ to 50μ range; the ones of greatest interest here are 25μ to 38μ thick. But one requirement in flat panel manufacture is the generation of ever smaller features, in the 10μ to 5μ range. This presents some difficulty with resists in the 30μ to 50μ range, and less of a problem with resists in the 5μ to 10μ range.

Figure 4A:
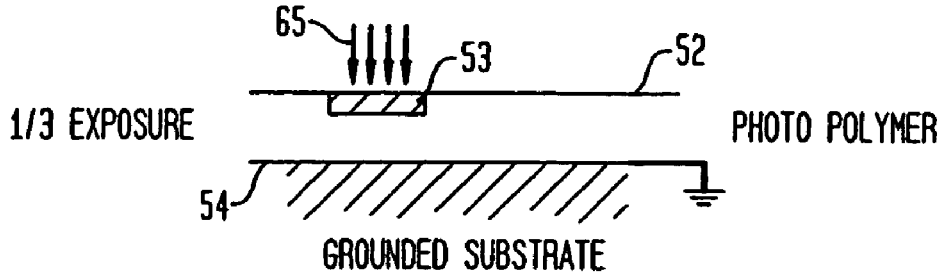
FIGS. 4*a-c* illustrate the progressive exposure of the electrostatic printing plate.
Figure 4B:
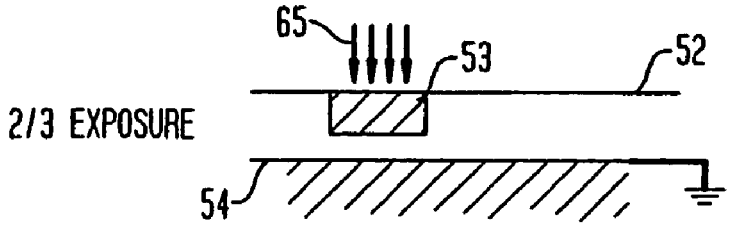
Figure 4C:
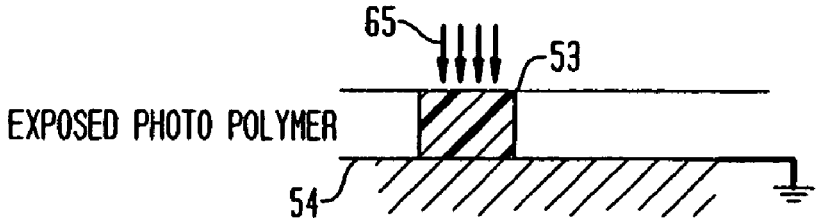
Figure 4D:
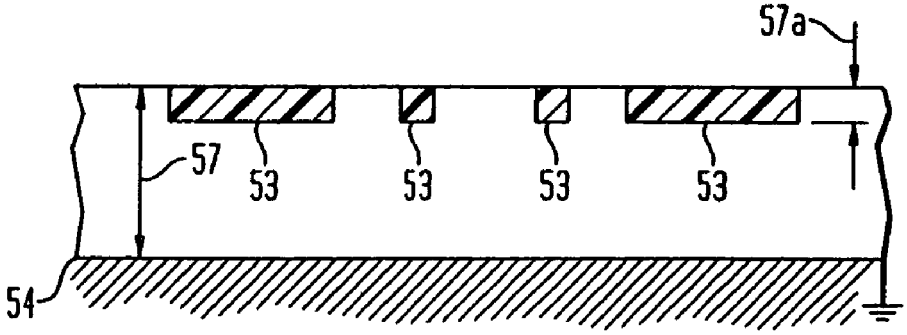
FIG. 4*d* illustrates a plate exposed one quarter of its thickness.

An important feature of this system is the partial exposure of the photo resist. Data has shown that the photopolymer 52 is exposed in ever increasing thickness of a layer 57 starting at its surface, as shown in FIG. 4*a* through 4*c*. Increasingly by longer exposure to actinic radiation 60 cross-links ever deeper layer of the photo polymer. Therefore if one is using photopolymer at 38 micron thick but wants to make 5μ features, one might expose only one quarter 57 a of it in thickness 57 as shown in FIG. 4*b*. One now has highly resistive image in a "sea" of less resistive background areas. Since we never remove the unexposed background areas (and indeed their presence is a critical element in the success of the process, as discussed next), the partially exposed (or unexposed layers under the image) present no problems. One determines the proper level of exposure for the "partial exposure" condition by a series of increasing exposure levels and measuring the charge voltage in large solid areas.

Figure 5A:
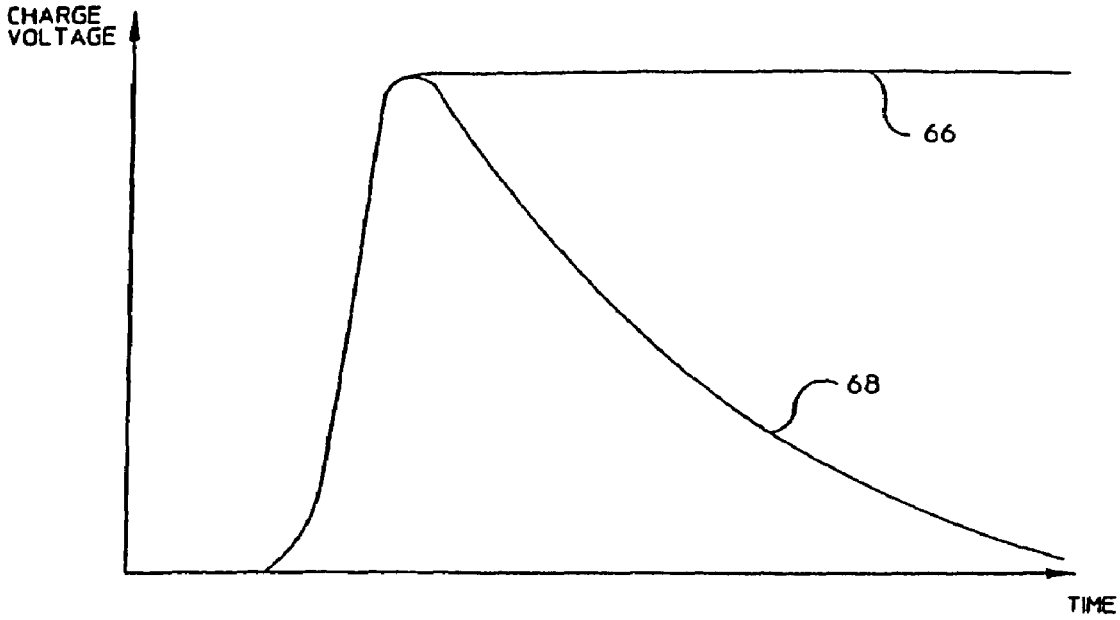
FIGS. 5*a-b* illustrates the ideal and typical charge decay cures for the electrostatic printing plate.
Figure 5B:
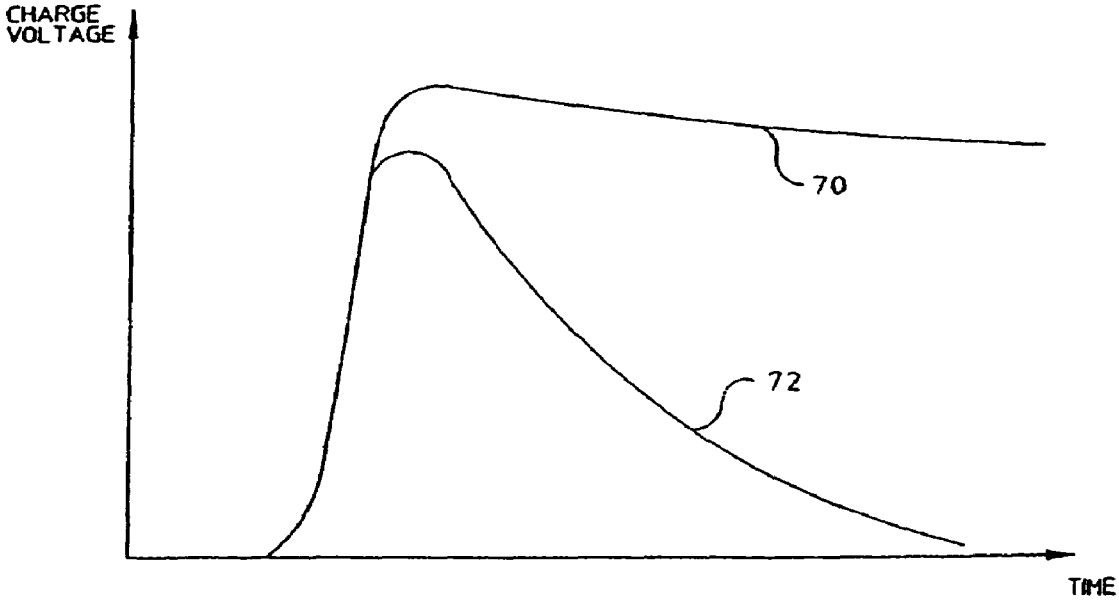

A second important feature of this system is the need to keep the initial charge voltage on the exposed and unexposed regions to be either equal or with in 50% of each other (i.e. V unexposed=0.5 V exposed). The reasons for this are subtle, but crucial, for the success of the process. FIG. 5*a* shows the ideal charge decay curves for the image elements 66 (V exposed=f(t)) and the background regions 68. (V unexposed=f(t)). Note after a short period of time there is no voltage in the background regions while the voltage and the image elements has decayed very little. While this is ideal and theoretically achievable in practice the initial charge voltage in the unexposed regions of the plate should be 50% or more of those values for the exposed regions as shown in FIG. 5*b*, exposed 70 and unexposed 72. The reason for this is a phenomenon called the "island effect". Basically a small spot of a good dielectric like PET setting on a "sea" of bare copper cannot be charged to any significant value because of the electric field lines from the "island" to its surrounding "sea" which is at zero or grounded potential. These "field lines" direct incoming electric charge away from the image element and they land on the background areas.

Some photopolymers in the unexposed condition turn out to be "too" conductive and will not charge up to any significant value under the corona charge. Such plates when imaged by simple conditions will develop out the large image features but small image detail or fine structures are lost.

Such photopolymers can be used if one gives them a broad pre-exposure of the unexposed plate to bring it up to the proper electrical resistivity so that the initial voltage in the background areas is adequate. Then the pre-exposed plate is imaged with a photo-tool to produce a proper image above the pre-exposed level. This has been done is silver halide for years and is called "pre-fogging" of the plate. Pre-exposure of an electrostatic printing plate is discussed in prior art literature such as Bujese in U.S. Pat. No. 4,968,570.

Other photopolymers have just the proper level of resistivity in the unexposed regions and require no pre-exposure or "pre-fogging". Some materials easily pick up moisture from the air and their intrinsic or unexposed resistivity depends upon their storage history and packaging. Generally these effects are not troublesome once known by the user and proper modern packaging and careful storage can yield a well defined photopolymer plate. Bench mark testing of each batch of photopolymer will easily yield data to define proper exposure and "pre-fog" exposure if needed.

A third aspect of an optimized electrostatic printing process is the design and "type" of corona unit use as the charge corona. The machine design shown in the invention includes an AC erase discharge corona located just in front of the charge or sensitizing corona. By careful attention to design the AC corona will "reset" or discharge all areas of the plate after the last print cycle. Now the plate is ready to be charged. Ideally the charging corona will charge all areas of the plate to the same voltage whether they be large solid areas of image, large areas of background (the unexposed regions) and the fine image structure.

There are basically four different structures used to make corona units in copiers and printers:

1. The familiar bare wire in a metallic shroud.
2. The unit "a" with an electrically biased metal screen or grid between it and the plate or drum (the Xerox trademark for this is a scorotron).
3. The glass coated wire driven by an AC signal in a "U" shaped shroud that has a DC bias, the dicorotron).
4. An etched metal "saw tooth" structure of corona emitting points.

The above approaches have different voltage versus corona current densities that will show which one is optimum for this situation. The electrostatic printing plate poses new problems for corona design. The plate has areas of two different electrical resistivities, the high resistivity charge retaining layer and the lower resistivity background regions. It has already been discussed how a plate could be pre-fogged to raise the background area resistivity to a point where its charge voltage would decay to a negligible value (typically 10% of the initial voltage) within the process time between charging and development. Given that this has been accomplished, the initial charge voltage in the non-exposed or background areas are a fraction of the initial voltage in the exposed areas can be maximized by the choice of charge corona type and its design details. Procedures to accomplish this will now be described.

The various corona devices in use are shown in FIG. 6. The top figure shows the oldest design dating to the late 1950's, the corona unit 74 or a bare wire usually gold plated tungsten of 50μ to 75μ in diameter in a grounded metal shroud. In some designs the front aperture was constricted inward to serve as a self extinguishing function in that the surface to be charged would not exceed a certain value. This was important otherwise the drum voltage, if excessive, could puncture the photo conductive surface of the drums used at that time, causing permanent damage.

Figure 6A:
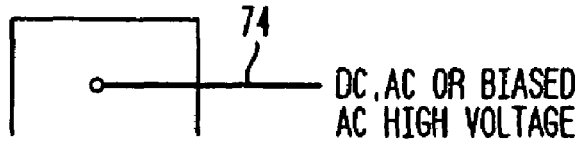
FIGS. 6*a-d* illustrates the four typical corona devices used in copy machine and electrostatic printers.
Figure 6B:
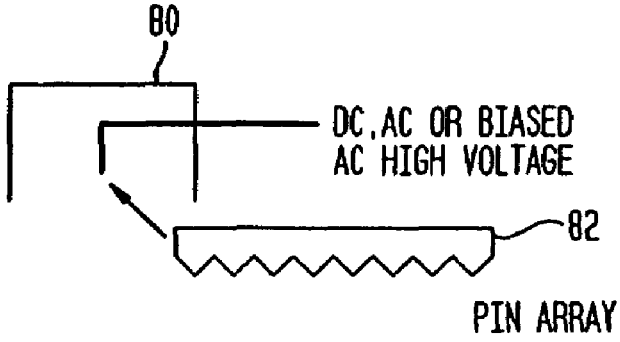
Figure 6C:
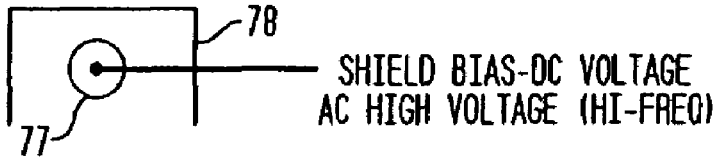
Figure 6D:
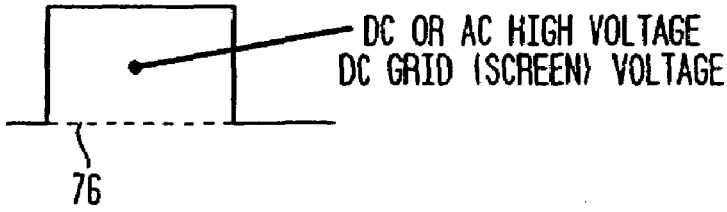

An earlier version of the "pinched" design was the scorotron at the bottom of FIG. 6*d*. Here a metallic grid 76 structure in front of the corona wire is biased to a voltage above the desired surface voltage (typically +800 for a 60μ thick amorphous selenium layer).

The cost of the 1000 volt power supply to bias the grid structure and the assembly costs of the scorotron versus the corotron were the reason for the design of the "pinched-in" Corotron of FIG. 6*a*.

One problem with the simple corona unit is that in the negative mode the corona discharge is not positionally stable but moves back and forth randomly. One "fix" for this is to super-impress on the DC voltage to the corona wire, typically a ripple value of 10% to 20% of the DC. This caused the high intensity nodes of negative corona discharge to move down the wire at the AC frequency (usually 50 or 60 Hz). This simple, low cost solution was adequate for low speed copiers or printers, but when higher speed units were being designed, a new corona structure, the dicorotron 78 was invented, see FIG. 6*c*. This used a glass coated wire 77 which was driven by an ac voltage. The shroud (or shield) was biased to a DC voltage which would define whether positive or negative charge was extracted by the corona unit. This design has the advantages of a large diameter glass coated wires that was not easily "fouled" with random dust or toner particles. The bias power supply for the shield was also a low cost design. One unfortunate aspect of this design was that the dicorotron corona unit produced considerable levels of ozone. This trace gas is becoming unacceptable in the office environment.

Figure 7A:
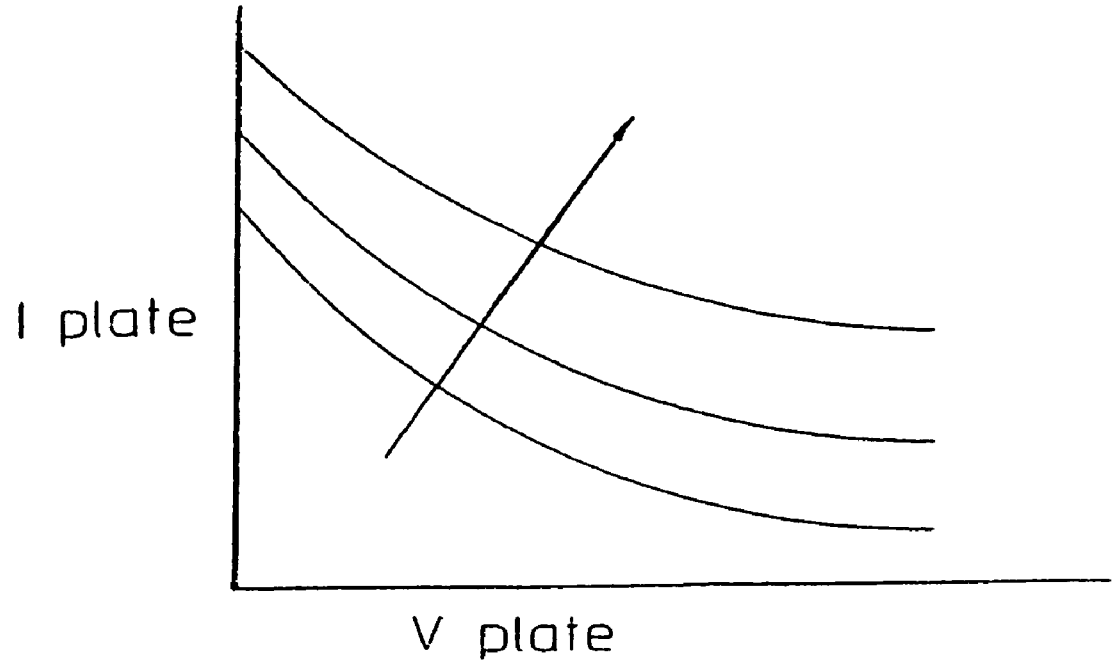
FIGS. 7*a-b* illustrates the printing plate current versus voltage for smooth wire and pin array corona units respectively.
Figure 7B:
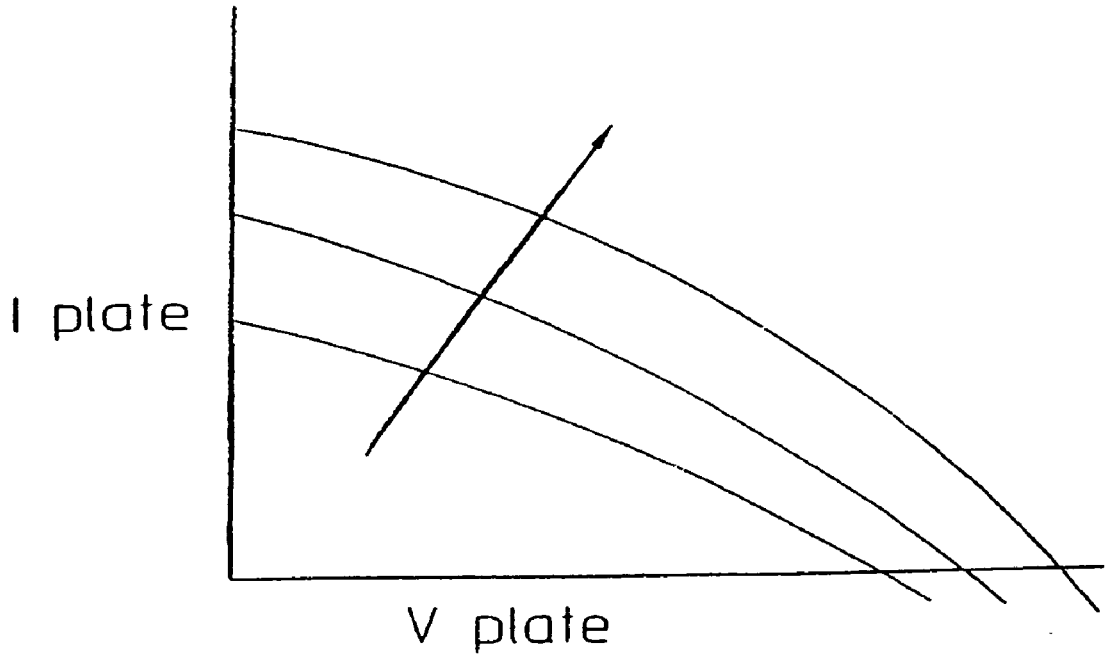
Figure 8A:
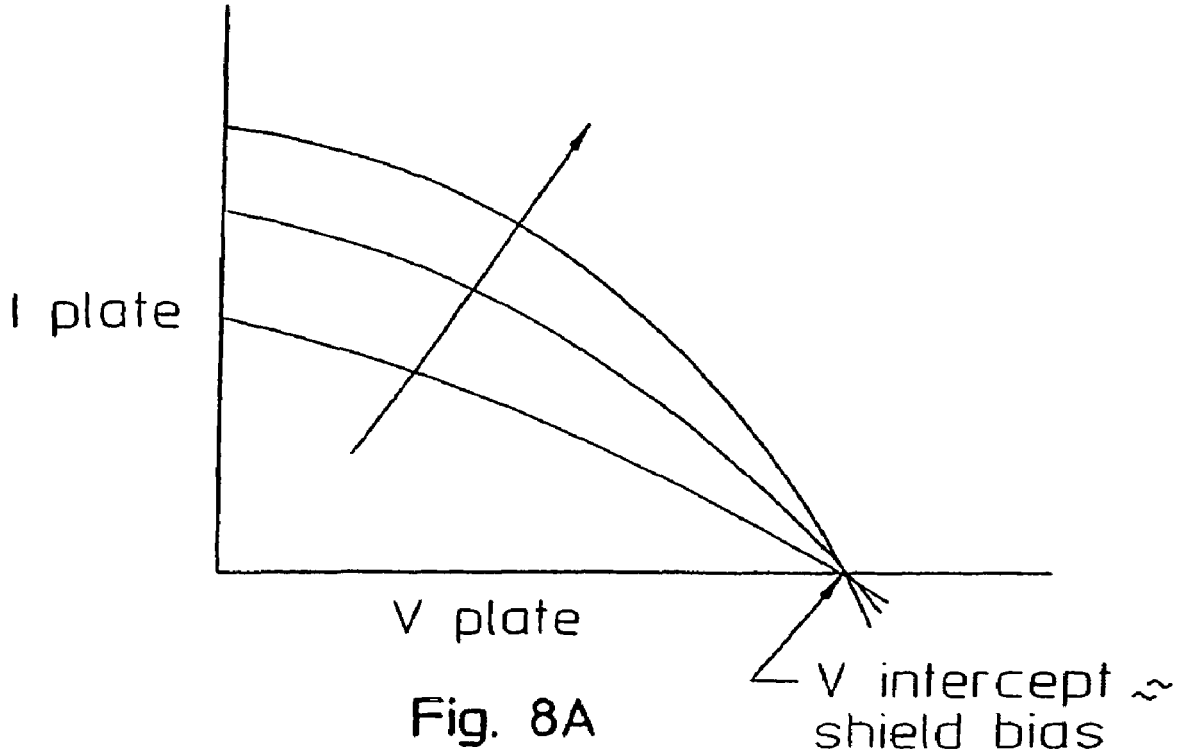
FIGS. 8*a-b* illustrates the printing plate current versus the voltage on the plate for dicorotrons and scorotons respectively.
Figure 8B:
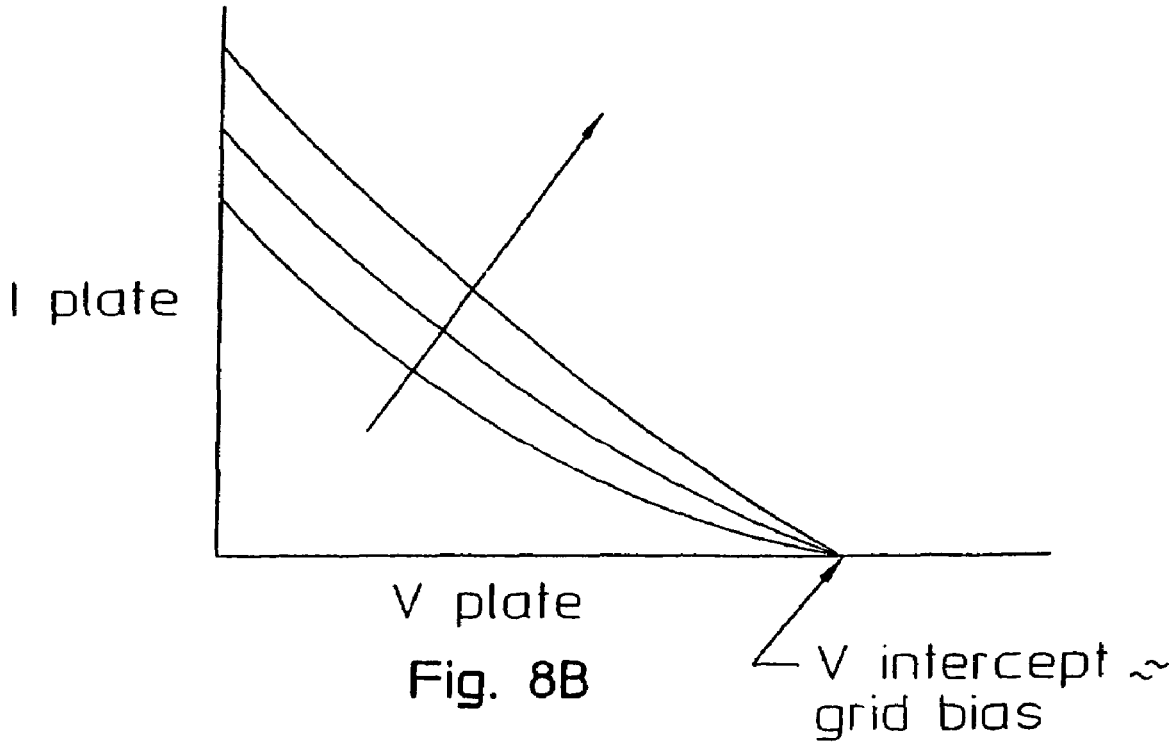

That situation led to the design of the "pin corotron" 80 or a saw tooth edge 82 that is driven to a high voltage. With a properly made "saw tooth" the corona unit produced very uniform corona discharges, especially negative discharges. This corona unit has been highly successful in recent Xerox® organic photoreceptor machines. The important performance characteristics of a corona unit is the current to the plate to be charged versus the voltage to which the plate has charged. FIGS. 7 and 8 show these curves. Note that the wire and pin corotron have the same V-i curves FIG. 7*a* but that the AC curve FIG. 7*b* is quite different from the DC curve.

This system uses an ac neutralizing corona unit to discharge the printing plate at the end of the printing cycle. Either the bare wire or pin corona are adequate for this job. The charging corona is located just after the neutralizing corona. Here a V-i curve is desired that will best charge the exposed and unexposed regions of the printing plate to the same voltage.

The ideal voltage-current characteristic from the corona unit would be one in which the corona current density (in microamps/cm$^2$) would be independent of printing plate voltage, or a flat straight line in FIGS. 7 and 8. Then if the plate is charged quickly, both exposed and unexposed plate areas would charge to the same value, after a suitable delay the unexposed regions would decay to a negligible value yielding an excellent electrostatic "contrast" (the difference between image and background).

Therefore, the best corotron design for this invention is the DC bare wire or pin corotron whose V-i curve is shown on FIG. 7*a*. It's V-i curves are the "flattest" of the four types of corona units and will yield the high ratio of unexposed to exposed initial charge voltage.

Details of the Transfer Process

An important part of the system relates to details of the transfer process not usually encountered in typical transfer processes to film and paper in the copying and laser printing industries. There toner, either liquid or dry is transferred to relatively thin webs of paper or polymeric film, typically 75 to 100 micron and in all cases the web is in virtual contact with the image surface.

The function particle toner of this invention is transferred to relatively thick layer of glass, 0.5 to 3.0 mm thick (500 to 3,000 micron) spaced away from the image by a fluid filled mechanical gap of 50 to 150 microns. Relative conductivities of the glass versus the gap filling liquid (toner plus added diluent), capacitances, applied voltages and the time over which they are applied etc. are important.

Figure 9:
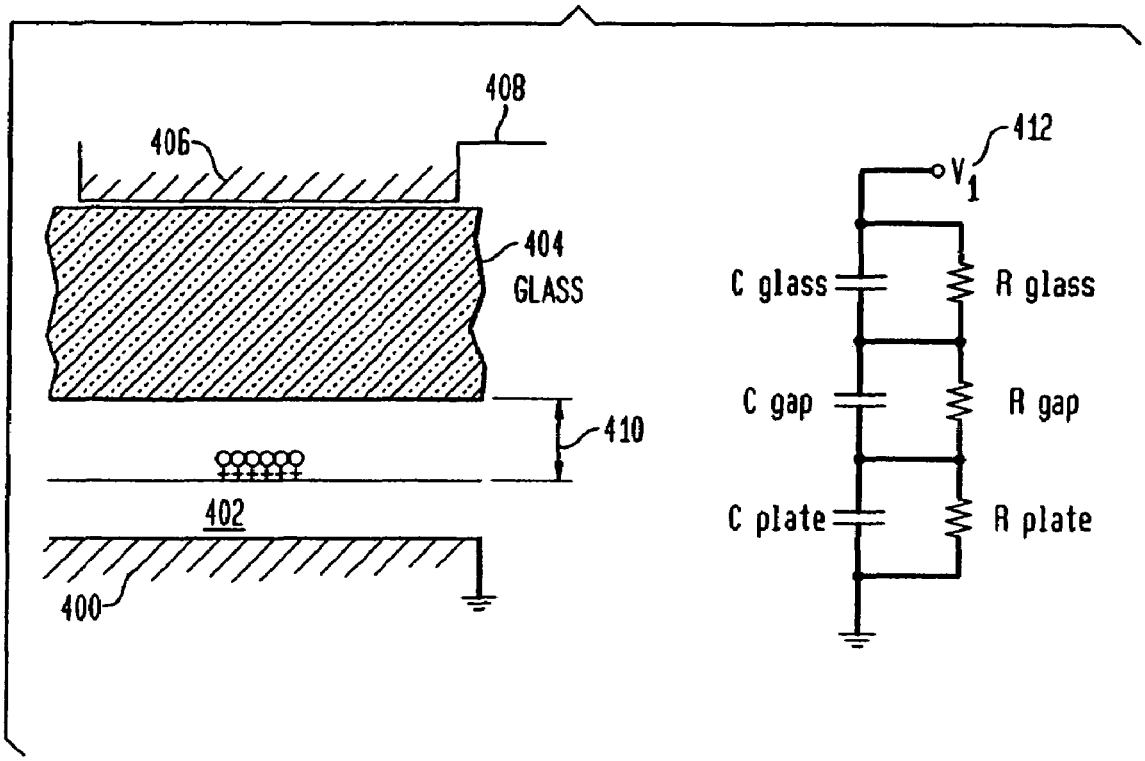
FIG. 9 illustrates the plate/glass layout with its equivalent circuit.

FIG. 9 shows a mechanical schematic of the transfer process and a electrical equivalent circuit which allows one to calculate the voltage division across the three elements (glass, gap, and printing plate) during the transfer process.

A. Electrical Conductivity of the Glass Versus the Conductivity of the Gap Liquid The most critical issues are the conductivities of the liquids in the gap versus the glass as this determines the voltage division between glass and gap. If most of the voltage appears across the glass and very little across the gap between plate and glass, all of toner will transfer. This is best illustrated by some examples:

Printing plate 400 consists of a photopolymer 402 of 10 to 50 micron thickness connected to electrical ground. Receiving glass plate 404 of typical thickness 0.5 to 3.0 mm thickness is backed by a field electrode 406 connected to transfer voltage 408. It is separated by mechanical gap 410 from printing plate 400. The equivalent circuit for this structure 412 is shown to the right.

A-1. A Glass of Interest is Electroviere ELC-7401 Made in Switzerland.

If charged and then the voltage decay measured it shows a decay time constant of 1 second which calculates to a resistivity of $2\times10^{+12}$ ohm·cm. Typical ranges of toner bath conductivities are of the order 10 to 100 pico mho/cm ($10^{-11}$ to $10^{-10}$ Ω·cm resistivity). There is one caveat to be disclosed. The charging test with the glass is a dc test and measures the flow of electronic charges through the glass, while the measure of toner conductivity is an 18 hertz test that measures back and forth flow of electrons, ions, and charged toner particles.

Now applying electromagnetic theory to the glass 404/gap 410 structure initially when a step function of voltage is applied the voltages divide capacities between the elements, glass, gap, and plate. Since the imaged areas of the plate 400 are highly resistive they can be disregarded for short periods of time. Since the glass is thicker than the gap, typically 10 to 100 times, and it's dielectric constant is 5 verses 2.1 of the liquids in the gap, the voltages divided preferentially across the glass with little across the gap. If the conductivity of the gap fluids is higher than the glass this situation will worsen the time and transfer will be inhibited.

With time, the voltages divide resistively between glass and gap. If the conductivity of the gap fluids is higher than that of the glass, practically all of the voltage is across the glass and none across the gap. If toner had transferred, it will back transfer due to the image charges on the printing plate. This, in fact has been observed.

A-2 Conductivity of the Diluent Used to Fill the Gap

Typically when a printing plate is imaged excess toner fluids are very effectively removed by a "reverse roller" that scavenges liquid containing random background particles; the result being an almost dry plate. Now the plate and glass are placed in proximity with each other and the gap between them filled with fluid. If one fills the gap with clear Isopar (conductivity less than 0.15 pmho/cm) the toner charge may be reduced by the lack of charge director is the clear Isopar. If one fills the gap with Isopar plus charge director with a conductivity of 20 pico mho/cm, the voltage division between glass and gap suffers. Again the demands of maintaining charge on the toner particles versus the conductivity of the gap fluids conflict. Conductive Isopar in the gap is desired but may not be possible if the glass has very high electrical resistivity.

Figure 10A:
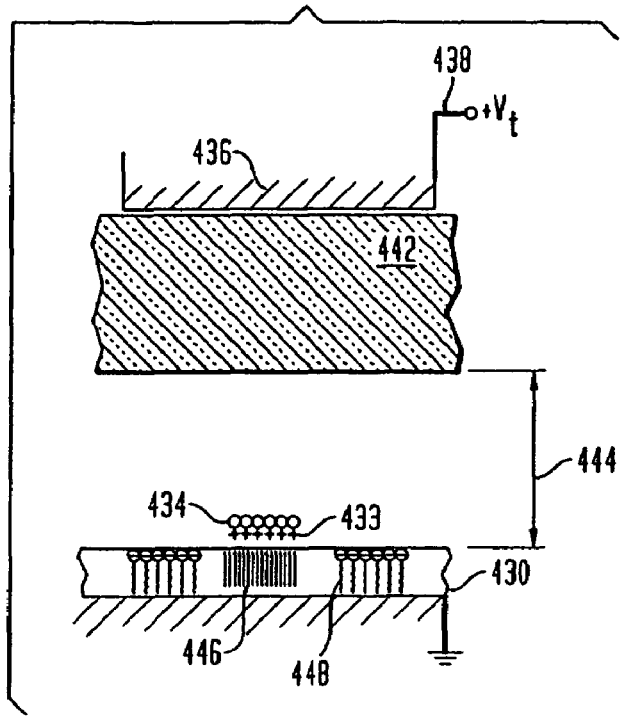
FIGS. 10*a-b* illustrate electrical changes induced in printing plate during the transfer step.

Printing plates 430 and 432 in FIGS. 10*a* and *b* respectively are "negative" images of each other. 430 is cross linked in the image area and developed with toner 434. 432 is cross-linked in the non-image areas and developed with toner 434. Both plates are sensitized with charges 433. Field plates 436 are driven by voltages 438 and 440 respectively. Receiving glass 442 accepts the transferred image. Mechanical gap 444 is filled with transfer fluid (not shown). High resistivity regions 446 are the cross-linked regions of the plate. Induced charges 448 occur when the transfer voltage is applied and are restricted to the non-cross linked regions of the plate.

Mounting Techniques for the Printing Plate and Glass

To preserve the fidelity of the toner image on the plate the transfer electric field must be everywhere normal to the plane of the plate and undistorted on the edges. And since we are transferring to glass with a resistivity of the order of $10^{+12}$ to $10^{+16}$ ohm·cm the mounting and holding of the plate must be consistent with these resistivities, i.e. these fixtures must be of materials substantially higher in resistivity. Even with the most conductive glass (lowest resistivity of $10^{+12}$ ohm·cm) some typical engineering materials, like cotton filled phenolics or poly acetals (Delrin of DuPont) may not be adequate for the job. For instance, Corning 7059 or 1737 glass is typically used for liquid crystal display panels for lap top computers. They have a resistivity of the order of $10^{+16}$ ohm·cm. A cotton filled phenolic resin material would not be adequate. Teflon™ type materials with resistivities of $10^{+18}$ are needed.

Also the conductivity of the bath can cause problems around the edges of the printing plate. Since the substrate of the plate is electrical ground, the conductive gap filling liquids might distort the electric fields near the edges of the glass/plate assembly if they can contact electrical ground causing distorted image transfer.

Induced Charges in the Printing Plate During Image Transfer

An important feature of using the fixed resistivity configuration electrostatic printing plate is a phenomenon that helps to "focus" or direct the toner particles during transfer if the plate is used in the normal imaging mode. By this it is meant that the toner develops the charged areas of the plate; as opposed to the "reversal" mode where the discharged areas of the plate are developed with toner particles. The former is used in a typical office copier while the latter is used in a laser or LED printer.

Figure 10B:
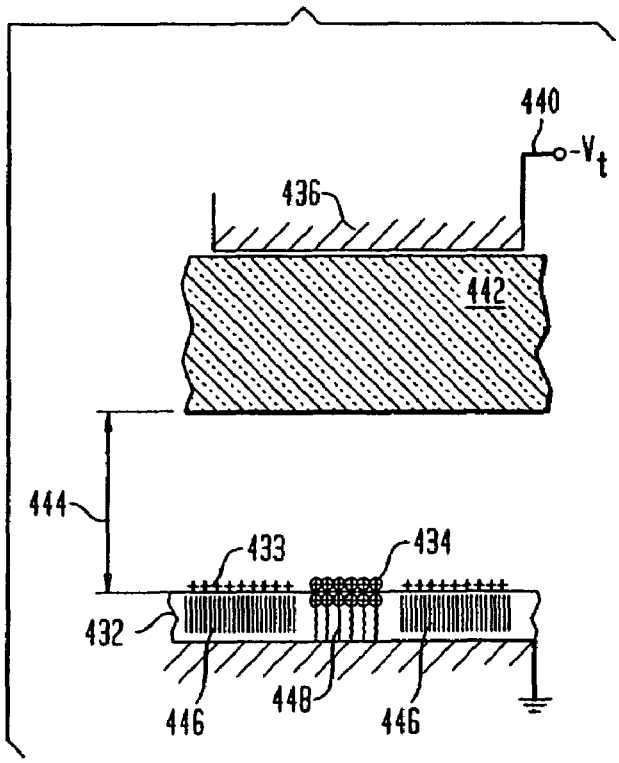

Refer to FIGS. 10*a* and *b*. FIG. 10*a* shows the normal imaging mode, positive sensitizing charges developed with negative toner particles and transferred with a positive electric field. FIG. 10*b* shows reversal with again positive sensitizing charges, positive toner particles transferred with a negative electric field. Note the charge retaining areas of the printing plate, they are highly resistive necessarily to retain the sensitizing charges. The other areas of the plate (areas not cross-linked in the plate exposure step) are much lower in resistivity.

During the transfer step, the transfer field "induces" electrical charges in these lower resistivity areas of the plate, which produces a significant result. Note the charge configuration in the "normal mode" plate, FIG. 10*a*. The sensitizing charges are positive while the induced background area charges are negative. These background area negative charges enhance the strength of the imaging fields and help to control the direction of the toner particles during the transfer step. In the "reversal plate" (FIG. 10*b*), charges induced in the lower resistivity regions of the plate (the non-cross-linked regions) are of the same polarity as the imaging fields and tend to reduce the fields. Indeed if the induced charge density equals that of the sensitizing charges there is no longer an imaging field and toner particles are free to move laterally during the transfer step. This will cause significant "de-focusing" of the transferred toner image. For this reason, normal imaging is preferred when using the electrostatic printing plate for highest resolution images.

In summary, electrostatic printing process for printing functional materials on glass plates is a simple one with few process steps. It has these advantages over current technologies:

1. It is a simple, direct process that proceeds at high rates, to 1 meter/sec.
2. It deposits a wide range of functional materials (conductors, insulators, phosphors, catalyst, etc.) to high definition or resolution with precise positional accuracy (called "overlay" accuracy in the silicon chip industry).
3. It prints on the glass surface without contact which has these advantages:

a. mechanical tolerances are loosened in the design of production machinery.

b. previously printed materials are not disturbed.

c. it can print on a relief surface. In fact the invention can print a conductive line at the bottom of a 100μ deep trench.

d. the invention can coat the bottom and walls of the trench with a phosphor material or other applications not yet defined.

4. There is no photolithographic patterning of the glass.
5. There is no mechanical handling of the glass from step to step. We load a clean sheet of glass into the printing device and Out comes a finished plate ready for sintering.
6. The process is a room temperature process, so critical to large geometries due to thermal expansion of the glass. In the printing of color filters, the four filter colors are printed at room temperature, then baked at once.
7. Expensive functional material is not wasted.

First Alternate System

Figure 11:
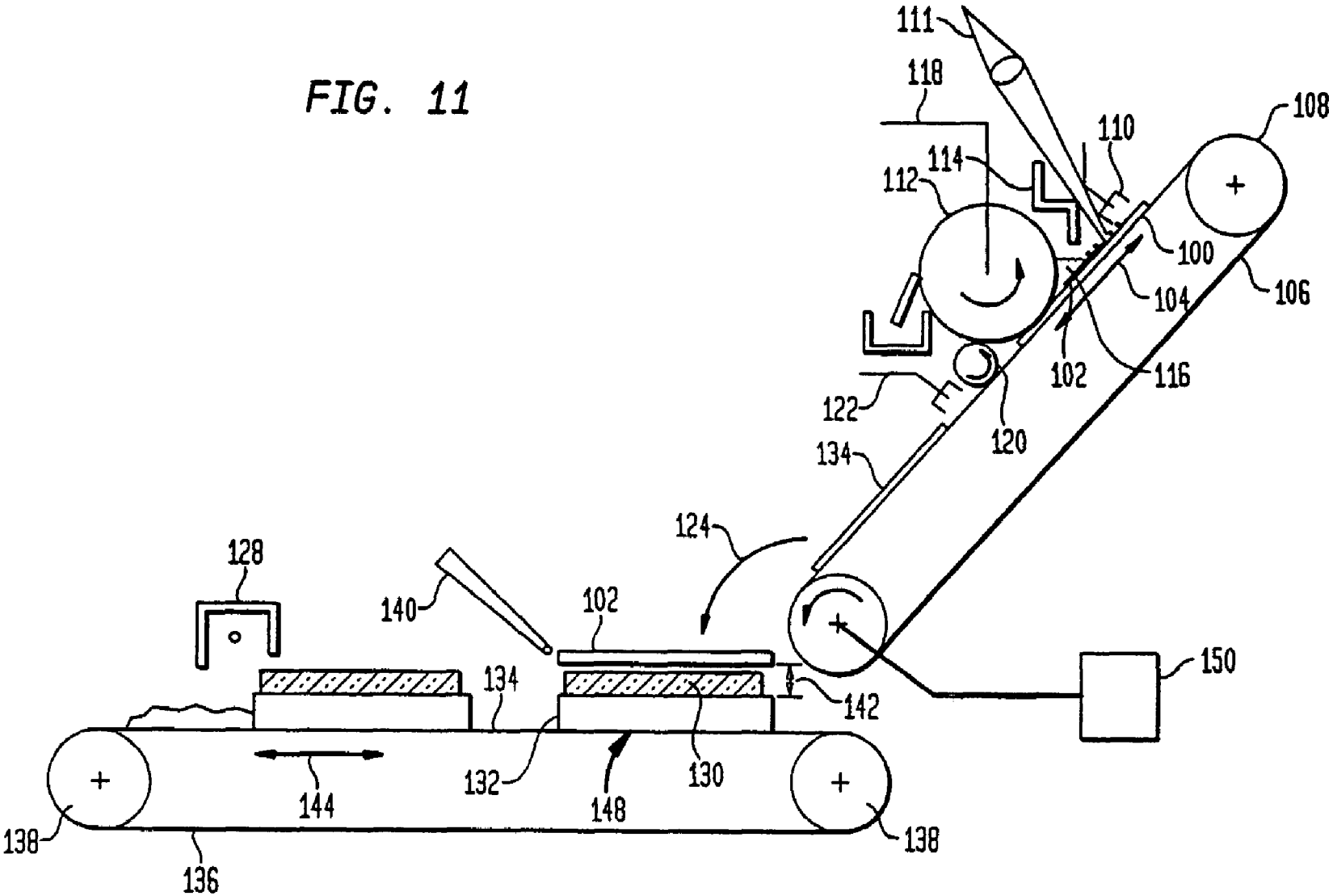
FIG. 11 illustrates a mechanical schematic of a "flat" to "flat" printing apparatus.

FIG. 11 shows this system. Chuck 100 carrying electrostatic printing plate 102 is transported on linear bearings 104 by belt drive 106, canted at roughly a 45° angle to the horizontal. At the beginning of the print cycle chuck 100 starts at the top near pulley 108. Moving at uniform speed it passes corona unit 110 which charges the printing plate, 102 with a uniform electrostatic charge. After a short period of time, the low resistivity areas of the plate will discharge to a negligible charge level; the high resistivity areas of the plate retain the charge to near original levels.

This latent electrostatic image is now developed by the liquid toner of this invention which floods the gap between developer roll 112 and plate 102. Valve 114 floods this gap with a measured quantity of liquid toner 116. Developer roll 112 has an electrical bias voltage 118 which controls the accumulation of unwanted toner particles in background areas of the image. After passing between the developer roll plate 102 is stripped of excess liquids by reverse roll 120. After this the liquid toner is compacted by "depress" corona 122. The image is now finally developed and ready for transfer to the receiving substrate.

Receiving substrate 130 rests on its chuck 132 which rides on linear drive 134 driven by belts 136 and pulleys 138. It moves right past valve 140 which wets it with a thin layer of clear Isopar diluent. It moves to transfer position 142 and stops. Chuck 100 carrying printing plate 102 rotates approximately 135° counter clock wise to a position in obverse relation to receiving substrate 130. Spacing means not shown, accurately position plate 102 from receiving substrate 130 by a precisely controlled mechanical gap, typically of the order of 50μ to 150μ. A voltage is applied to chuck 132 to create a transfer electric field which transfers the toner image on plate 102 to receiving substrate 130.

Chuck 100 with printing plate 102 is now lifted vertically by means not shown or simply rotated clock wise by approximately 135° to its original position. Receiving substrate 130 is now dried before removing it from its chuck 132. Plate 102 is now moved up the 45° ramp and cleaned by suitable means, not shown, to repeat the next printing step. The timing and movements of the process and components can be synchronized by an electronic controller 150.

This manifestation of the system has advantages over the rotating process in that is a asynchronous, i.e. variable time intervals can be introduced between each step of the process; and transfer occurs in the flat to flat situation when hydrodynamic events and forces have subsided. Furthermore, the flat receiving substrate, which may be of the order 1 m×1.2 m must be on the bottom so it can be flooded by the diluent to fill the gap between the plate 102 and receiving substrate 130. Finally, the "overlay" accuracy of one flat plate, the printing plate; to a receiving sheet is much better, flat to flat, then in the dynamic situation of a moving flat sheet that needs to be accurately "phased" to a rotating print drum. Achieving very uniform linear and rotary drives are not trivial but phasing them "on the fly" to levels of their individual variations is a major task, all of which does not apply here.

Second Alternate System

Figure 12:
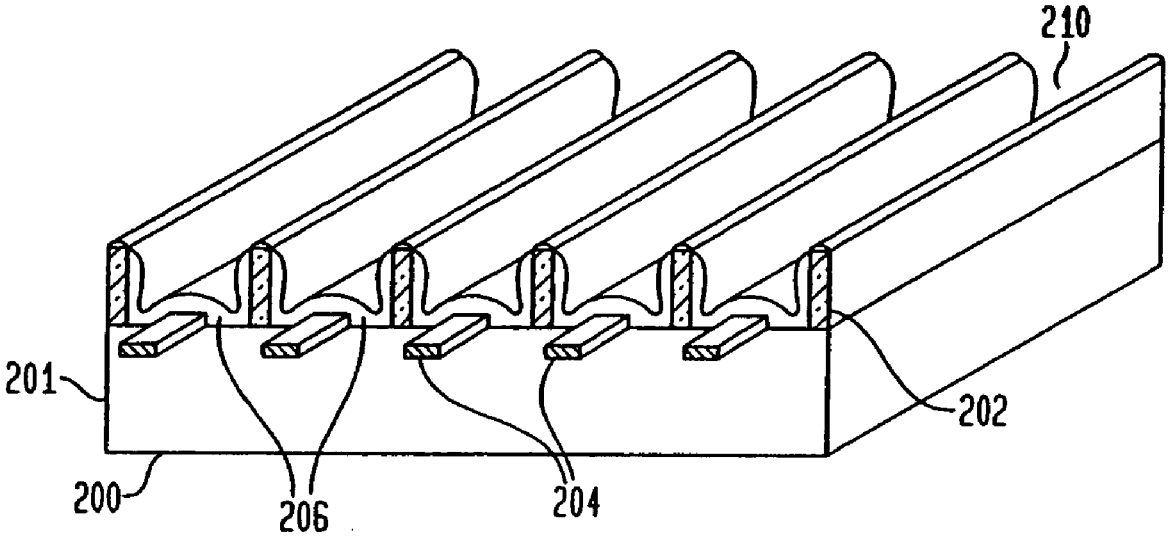
FIG. 12 illustrates a crossection of a typical AC plasma display panel.

FIG. 12 shows a cross section of the cathode plate 200 of an AC Plasma Color Display Panel. It consists of a glass back plate 201 with black glass spacer ribs 202 that optically and electrically isolated image cells 210 from one another. These ribs are typically 100μ high and 30μ to 40μ in nominal width. At the bottom of the "wells" are the address electrode lines of copper 204 or nickel metal. Covering the walls and bottom of the "canyons" is the phosphor 206 that converts the UV radiation from the plasma discharge to visible radiation, RG&B in the case of a color display. Alternate canyons are coated with red, then green then blue phosphor.

One advantage of the electrostatic printing technique is the non-contact or gap transfer aspect of it; i.e. the ability to transfer functional materials across relatively large mechanical gaps.

Figure 13A:
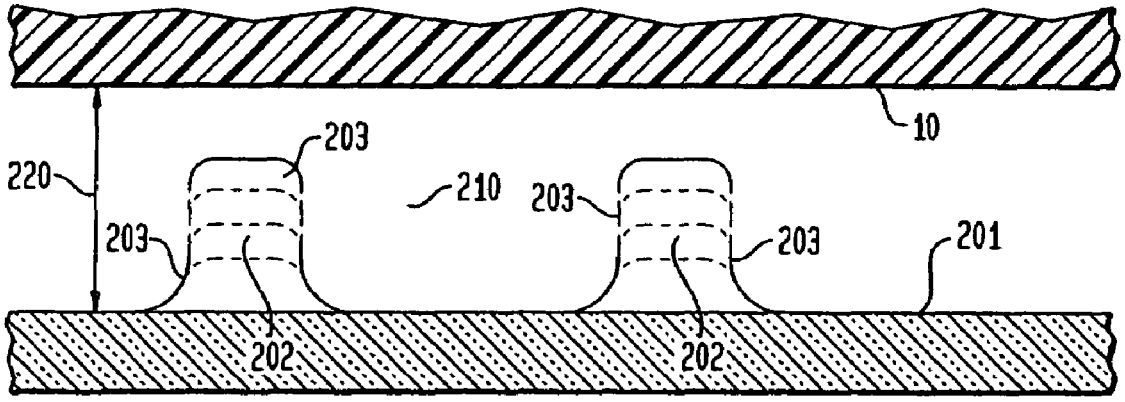
FIGS. 13*a-c* illustrate detailed sequences of manufacturing steps in the production of critical features of the AC plasma display.

FIG. 13A is a greatly magnified picture of the mechanical gap 220 between the print drum 10 and glass surface 201 of the invention. The gap here is set to a value of 150μ. In the first manufacturing step glass toner is printed to make the spacer/isolator ribs 202. Four layers of toner 203 is shown, each about 25μ high, one printed on top of the other. The manufacturing sequence is as follows:

Step 1 Print first layer of glass ribs

Step 2 Dry the toner by blowing warm air on it to partially set the resinous material that coats the glass particles. Note it is desired to maintain this as a constant temperature process so warm air is needed to compensate for the natural cooling that occurs with the evaporation of the diluent liquid Step 3 Reprint and dry the second layer of glass toner Step 4 Reprint and dry subsequent layers of glass toner until the desired height is achieved.

Step 5 Fire the glass panel at high temperature to burn off the resin in the toner and reflow the glass particles to make a solid rib.

Step 6 The rib manufacture process is now complete.

Figure 13B:
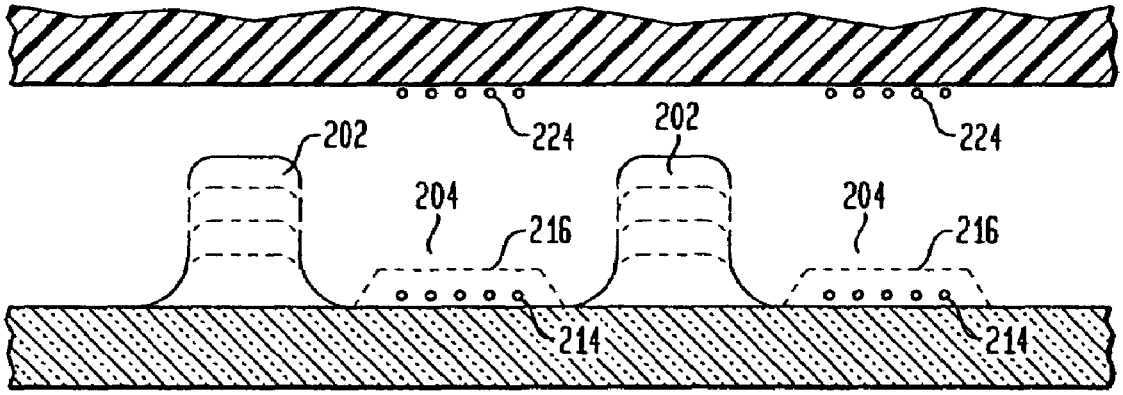

FIG. 13B shows the process for the printing of the metallic address electrodes 204 in the base of the canyons formed by the ribs. A palladium catalytic toner 224 is imaged on the drum and transferred across the 150μ gap 220 to the base of the canyons. The toner is dried leaving a very thin layer of palladium seeds 214 in a line that runs the length of the canyons. The plate is removed from the printing machine of the invention and immersed in an "electroless" plating bath. Metal grows from solution on the palladium seeds, then on previously plated metal. Electroless processes have advanced to a point where one can plate up to one micron of metal per minute. After the growth of about 25μ of metal 226, usually nickel, the cathode electrodes are complete.

Figure 13C:
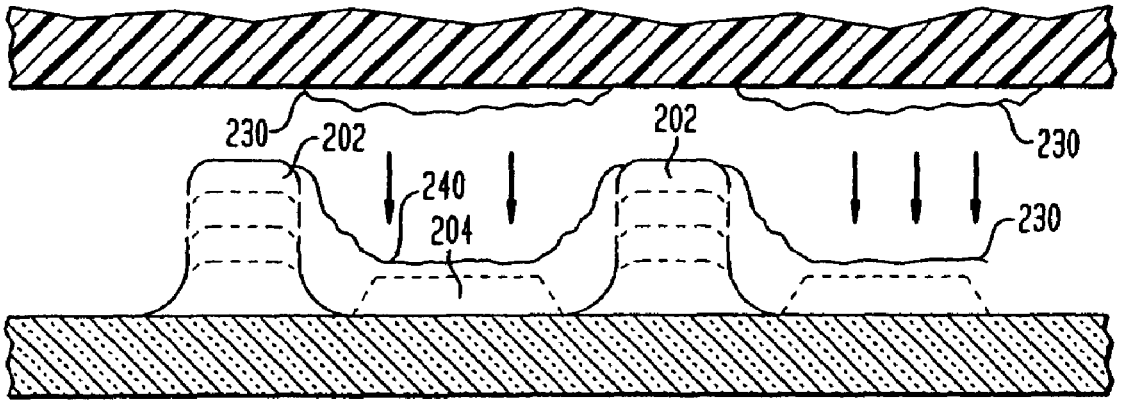

FIG. 13C shows the deposition of phosphor toner 230 in the canyons. Phosphor toner 230 is imaged on the plate 11 and transferred across the 150μ gap 220. Generally the transferred toner moves in straight lines but can coat relief images like coins. The toner image is sized to cover the walls of the canyons as well as the base where the electrodes are located. Note one phosphor color is imaged at a time so the printing plate has an image of every third canyon on it. After the first phosphor color 230 is imaged the toner is dried with warm air to set it; then the second color is imaged; then the third color. The same printing plate can be used for all three colors; all that is needed is to mechanically index the glass with respect to the printing drum.

The plasma display cathode plate is now finished. Glass ribs were built in 4 or 5 printing steps followed by a firing step to reflow the glass particles. Then electrodes were printed with a catalytic toner followed by an electroless plating step. Finally three color phosphors were printed in the canyons formed by the glass ribs.

Third Alternative System

An alternate method to produce conductors is to print metal toners themselves, to burn off the resin that coats the metal particles; then reflow the metal into a smooth conductor pattern. Using the preferred system one prints a toner having aluminum as the function particles onto the glass. The transferred toner is then dried to temporarily fix it for reasons of safe handling. Now a rapid thermal processing of the metal is effected, where the toner and glass are raised to a temperature of 50° to 100° C. below the softening point of the glass (approximately 500° C. for soda lime glass). This effectively burns off the resin that coats the metallic particles of the toner. Now with an intense UV light source, the aluminum is heated to its melting point while the glass absorbs little UV energy. Aluminum which melts at 659° C. is a good choice of materials to be used with soda lime glass. Note, this is not done in air but in a "reducing" atmosphere like one used in aluminum welding work.

Fourth Alternate System

Figure 14A:
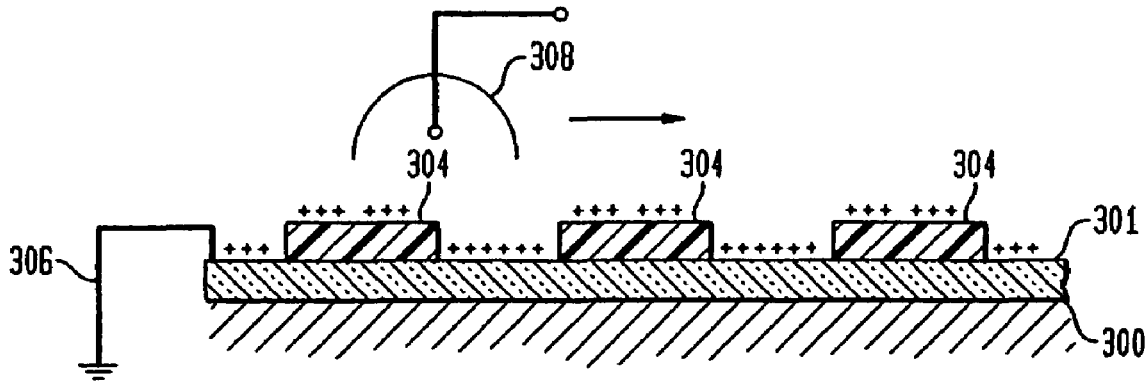
FIG. 14*a-c* illustrates the "self-printing" of the black intermatrix of a color filter panel

In this system the glass 300 in FIG. 14*a* is first coated with a thin, transparent layer 301 that is electrically conductive. This very thin layer is not shown. Indium Tin Oxide (ITO) is a possibility except it absorbs about 5 to 10% of the transmitted light and ITO processing is expensive, of the order of $5 per square foot. The ITO conductivity of 50 to 100 ohms per square for a typical 2μ thick layer is higher than needed for this electrostatic process. A conducting polymer as resistive as $10^{+5}$ ohms per square is adequate for this electrostatic process, all that is needed is to establish an electrostatic ground plane 302 as shown in FIG. 14*a*.

Figure 14B:
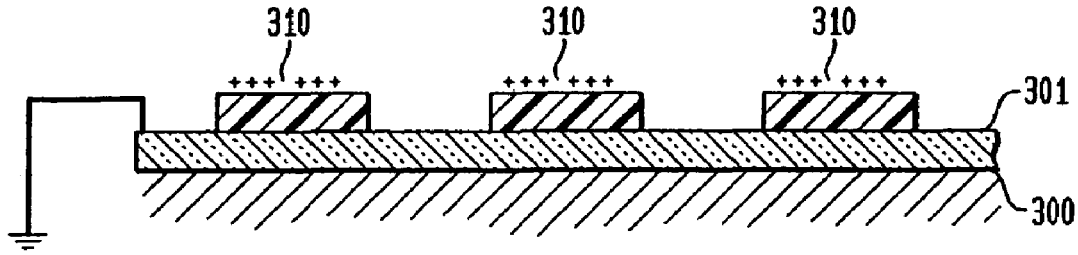

In this case the coated glass 300 is imaged with the RGB color mosaics 304 which are then reflowed by final heating. The plate is now complete except for the black intermatrix which has yet to be produced. Transparent conductive layer 301 is electrically grounded through edge contact 306 as shown in FIG. 14*a*. Now the entire plate is corona charged with a suitable corona generator 308 as in FIG. 14*a*. The conductive under layer discharges immediately, while the color mosaics retain their charge 310 for considerable periods of time, as much as thousands of a second depending on the resins used in the mosaics. The partially finished color filter plate is now its own electrostatic printing plate, as seen in FIG. 14*b*. It can be developed in the reversal mode (i.e. develop the discharged [or uncharged] areas of the image) as is done in virtually all desk top laser printers.

Figure 14C:
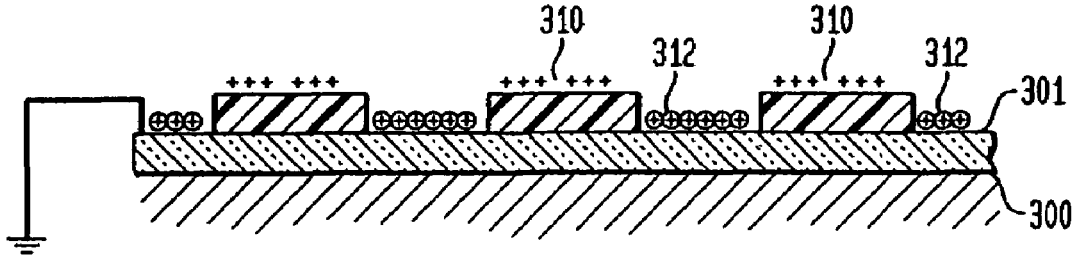

In the example shown, the mosaics are charged positively so a toner with a positive charge 310 will develop the non-charged areas as in FIG. 14*c*. This black toner 312 will produce the intermatrix between the mosaics. After the toner is dried, it may be reflowed by heating if necessary, but there are good reasons to leave it a particulate layer which will hold the unfused toner in place.

One of the principal advantages of this system is that the final printing operation of the black intermatrix is self-correcting of "self-healing". Any image defects in the mosaics will be over printed with black toner automatically. Also one does not need a high definition printing plate for the black intermatrix which must then be aligned to micron tolerances so as not to leave gaps between matrix and mosaic through which stray light will be passed. This self-correction feature is one of the greatest advantages of this embodiment.

Figure 14D:
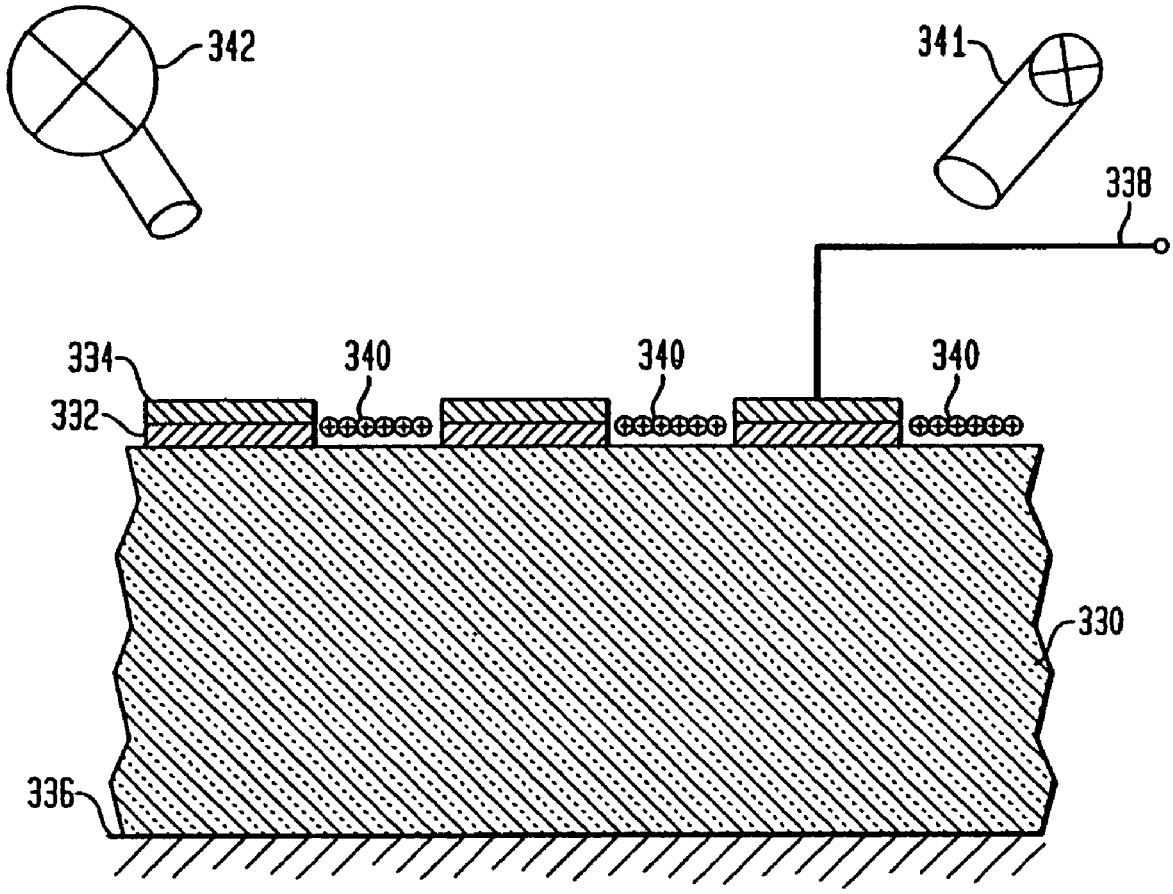
FIG. 14*d* illustrates the self-printing of a vacuum phosphor front panel.

Another "self-printing" example is shown in FIG. 14*d*. This glass plate #330 is typical of the face plate of a field emission display (FED). The glass is first coated with black chrome oxide #332 to enhance optical contrast and with a metallic chrome layer #334 to conduct away to ground the electrons that hit the phosphor. It is desired to coat phosphor in the bare spaces on the glass surface between the black chrome oxide 332. To "self-print" the phosphor toner the glass panel is placed on an electrically ground plate #336, chrome side up. Using a wire or metallic probe #338 the chrome layer is made to act as an electrode by connecting it to a high voltage power supply, as high as possible before electrical breakdown Occurs. Liquid toner is now poured over the plate and it is noted that toner #340 "develops" on the bare glass areas by means of the fringing electrical fields. If the toner particles have a positive charge on them, a positive voltage must be connected to the chrome layer; with negative toner conversely a negative voltage with respect to ground is needed. As before, open area defects in the chrome layer will have toner deposited on them in a "self-healing" manner.

EXAMPLE 1 OF THE PREFERRED SYSTEM

An electrostatic printing plate was made by laminating DynaChem 5038, product of DynaChem Inc., Tustin Calif., photopolymer dry film resist material to 0.003 inches thick black anodized aluminum foil from Lawrence and Frederick of Des Plaines, Ill. (the part number is 1145-003-1419-SB). The laminating was done on an industry standard dry film laminator made by Western Magnum. After cooling from the lamination process, the plate was exposed by a negative photo tool to nominal exposure level 100 milli joules/cm$^2$.

The plate was charged to a nominal image voltage of −800V by a corona discharge unit. After about 2 seconds it was developed with a glass particle liquid toner of example 2 by merely pouring the toner over it. Clear diluent (typically Isopar G®, Exxon Corp.) was used to wash away background particles. 125μ thick spacers were placed on the plate edges and a glass plate wetted with diluent was placed over the spacers. Care was taken to ensure that no air bubbles were trapped in the space between the printing plate and the glass plate. The same corona unit was used to charge the top side of the glass plate with negative corona charges. The glass plate was lifted and an excellent glass toner image was found on the bottom surface of the glass plate. The glass was standard window glass (soda lime float glass) 0.090 inches thick.

EXAMPLE 2 OF THE PREFERRED SYSTEM

Figure 15:
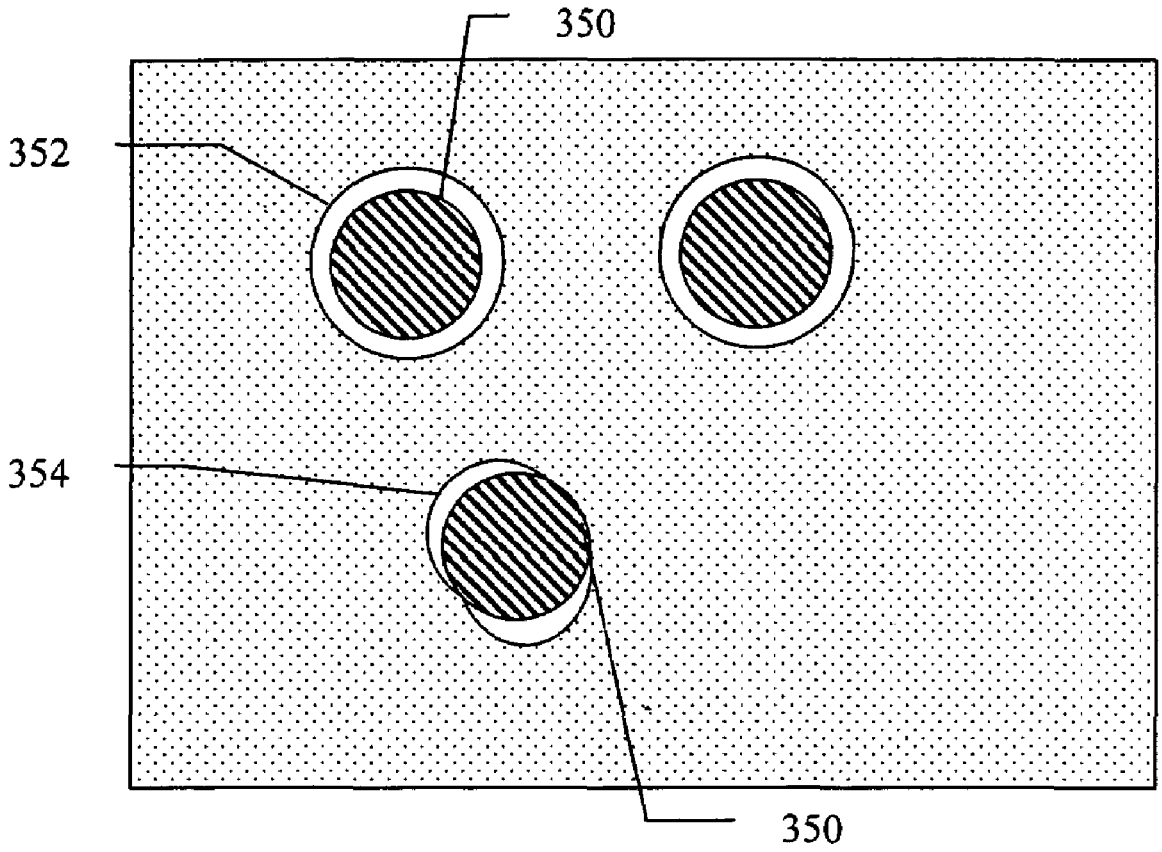
FIG. 15 illustrates an exemplary liquid toner of this invention.

FIG. 15 shows an exemplary liquid toner incorporating the inventive concepts of this invention, comprising a dilutent 356, functional particles 350, coating 352 and partial coating 354. The glass toner of example 1 comprises a non-polar organic dilutent and glass functional particles coated with a resin to provide the appropriate surface hydroxyl functionality. The toner was prepared using the "organosol" process as taught by Kosel in U.S. Pat. No. 3,900,412. An organosol resin was polymerized in Isopar H diluent following the methods of Kosel. The resin had a Tg of −1° C. and a core to shell ratio of 4. It was designated the nomenclature of JB8-1 (Aveka Inc., Woodbury, Mn.)

The toner contents were as follows:

| | |
|---|---|
| 75 | gm glass powder, Ferro Corporation, Cleveland, Ohio, #EG-2030-VEG |
| 25 | gm resin, JB8-1 |
| 2 | gm ZrHexCem, OMG Americas, Cleveland, Ohio, Prod. Cd. 949 |
| 300 | gms of Isopar L ®, Exxon Corporation |

It was processed for one hour in a Dispermat F105® vertical bead mill made by Byk-Gardner Incorporated of Germany. Processing was done at medium speed. The resulting toner had the following characteristics:

| | |
|---|---|
| mean particle size | 1.27μ |
| toner conductivity | 9.9 pico mho/cm |
| particle mobility | $3.06 \times 10^{-6}$ m$^2$/v · s |
| Z (or zeta) potential | 14.7 millivolts |

The glass particles have a true mass density of 5.2 while the Isopar L® has a density of 0.8 so the toner settles out substantially in 15 to 30 minutes. It can be successfully redispersed by moderately shaking of the toner containers by hand.

EXAMPLE 3 OF THE PREFERRED SYSTEM

Example #1 was repeated with the toner of example #2 but the toner was transferred to Cr coated glass. 75 mm×75 mm×1.2 mm Corning 7059® glass were sputter coated with 100 nm to 150 mm of pure chrome. The resulting surface had a brilliant shine to it. The Cr surface on the glass was wetted with Isopar and this wetted glass placed on the PET on a developed printing plate. The Cr surface was connected to a lab supply producing −1600V. Good glass toner images were transferred on the Cr coated glass. The PET spacers were 125μ thick.

EXAMPLE 4 OF THE PREFERRED EMBODIMENT

A catalytic toner was prepared with the following ingredients:

| | |
|---|---|
| 2 | gm of Palladium powder, Aldrich Chemical # 32666-6 |
| 17 | gm of organosol resin, JB-8-1 |
| 1 | gm of ZrHexChem |
| 100 | gm of Isopar L |

The mixture was dispersed in the vertical bead mill for 1.5 hours at 2,000 rpm. The resulting toner had these measured characteristics:

| | |
|---|---|
| mean particle size | 0.333μ |
| conductivity | 169 p mho/cm |

The toner was imaged using the plate of Example 1 and transferred to soda lime glass plates. These plates were dried then put into an electroless copper bath (typically Shippley CUPosit™ 328, Shippley Inc, Marlboro Mass.) for 10 minute at 23° C. Significant copper metal was visible on the glass surface.

EXAMPLE 5 OF THE PREFERRED SYSTEM

An aluminum powder toner was prepared by the following formulas:

| |
|---|
| 75 gm of Alex Al, Argonide Corp. |
| 25 gm of organosol resin JB-8-1 |
| 2 gm of ZrHexChem |
| 350 gm Isopar L |

The mixture was dispersed for 1.5 hours in the vertical bead mill and the resulting toner specifications were:

| | |
|---|---|
| mean particle size | 30μ |
| mobility | $6.95 \times 10^{-11}$ $m^2/v \cdot s$ |
| conductivity | 40 p mho/cm |
| zeta potential | 5,314 m volts |

The toner was imaged on the plate of example 1 and transferred to the same type of soda lime glass. After drying it was subjected to rapid thermal processing in the model CP-3545 RTP machine of Intevac of Rocklin, Calif. The toner and glass were pre-heated to 550° C. in a non-oxidizing atmosphere. It was then exposed to intense UV radiation that heated the aluminum toner but not the glass.

EXAMPLE 1 OF THE FOURTH ALTERNATE SYSTEM

A 1.1 mm thick plate of soda lime glass was patterned with black chrome oxide, then metallic chrome with phosphor openings of 60μ by 130μ in a solid pattern of 75 mm×100 mm. The plate was placed, chrome side LIP on a grounded copper plate. Electrical contact was made with the chrome surface and the power supply was turned on to +6,000 volts. No break down occurred. The chrome surface was flooded with the phosphor containing toner similar to Example #2, the difference was equal amounts of phosphor and resin, 50 g of phosphor, 50 g of JB8-1. Unwanted background was washed away with clear Isopar G. The plate was allowed to air dry at room temperature. Good phosphor toner images were noted in the clear spaces between the chrome fingers. The phosphor toner NP-1053A was obtained from Nichia Kagaku Kogyo, K.K., Tokashimaken, Japan.

EXAMPLE 1 OF THE FIRST ALTERNATE SYSTEM

A printing plate from 38 micron thick DynaChem 5038 photopolymer was charged and imaged with Indigo E-1000 toner with a concentration of 1.5% by weight and a conductivity of 25 pico mhos/cm. Corning 7059 glass 1 mm thick was placed on PET film, 25 microns thick spacers, above the plate. The gap between glass and plate was filled with pure Isopar G whose conductivity is less than 0.15 pico mho/cm. An electrode was placed on top of the 7059 glass and excited to +10 kv with respect to the grounded base of the printing plate. The transfer voltage was held for 10 minutes.

The glass was removed with the transfer voltage still applied and it was noted that no toner transferred. This shows that virtually all of the voltage appeared across the glass and none or little across the gap so no toner transferred.

Initially toner may have transferred to the glass due to the capacitive division of voltages between glass and gap (theoretically about 12% of the 10 kv or 1200 v), but as the voltage across the gap collapses, the toner would back transfer to the plate.

EXAMPLE 2 OF THE FIRST ALTERNATE SYSTEM

The plate of Example 1 of the First Alternate System was imaged and developed. Electroveere glass ELC-7401 with a resistivity of $2\times10^{+12}$ ohm·cm was placed on 50 micron thick PET spacers. The gap between glass and plate filled with Isopar G spiked with Indigo Imaging Agent to a conductivity of 12.4 pico mho/cm. A transfer voltage of 4 kv was applied to the top of the Electroveere glass for 5 seconds while linearly reducing it to 3 kv. The glass was removed with the 3 kv transfer voltage still applied.

An excellent image was seen on the glass with very good edge acuity. The image was superior to a similar image created, using just clear Isopar G (i.e. very low conductivity) to fill the gap, demonstrating that the charges on the toner particles are better preserved with the conductive gap filling liquid.

EXAMPLE 3 OF THE FIRST ALTERNATE SYSTEM

An image was created on the plate of Example 1 of the First Alternate Embodiment using that toner. 2.25 mm thick soda lime float glass (i.e. common window glass) was placed on 50 micron PET spacers, above the plate. Isopar G conductivity treated with Indigo Imaging Agent to a conductivity of 25 pico mho/cm was used to fill the gap between glass and plate. An electrode connected to 5 kv of voltage was placed on top of the plate, which was reduced to 3 kv in 5 seconds. The glass plate was lifted and an image of low density was found on the glass. A significant amount of toner remained untransferred on the printing plate. The conductivity of the gap liquid reduced the effective voltage across the gap causing poor transfer.

If clear Isopar G is used good, complete transfer occurs though edge acuity may suffer. With this moderately resistive glass (of the order $10^{+13}$ ohm·cm), the conductive Isopar in the gap reduces the voltage across the gap resulting in incomplete transfer.

In summary, this invention comprises a relatively uncomplicated high yield manufacturing process in which functional materials are configured as liquid electrographic toners that can be printed at commercially interesting rates of production in a non-contact mode. This non-contact feature allows one to print on non-flat surfaces or even relief surfaces such as ribbed surfaces.

While the invention has been described with reference to the preferred embodiments thereof it will be appreciated that various modifications can be made to the parts and methods that comprise the invention without departing from the spirit and scope thereof.

What is claimed is:

1. A liquid toner, comprising:

a liquid dilutent; and one or more electrically-conductive functional particles in suspension in said liquid, said functional particles having an active surface portion, said active surface portion comprising an etched region of said functional particle, and having a functionality chosen from an acidic functionality and a hydroxyl functionality.

2. The liquid toner of claim 1 wherein said etched region is etched by an acid solution thereby producing an acidic functionality.

3. The liquid toner of claim 1 wherein said etched region is etched by a basic solution thereby producing a basic functionality.

4. The liquid toner of claim 1 further comprising a surface coating covering at least a portion of the surface of said electrically-conductive functional material and wherein said surface coating comprises said active surface portion.

5. The liquid toner of claim 4 wherein said surface coating comprises a resin with appropriate acidic or hydroxyl functionality.

6. The liquid toner of claim 1 wherein said electrically-conductive functional particles have a mean particle size greater than or substantially equal to 0.3 microns.

7. The liquid toner of claim 1 wherein said electrically-conductive functional particles have a mean particle size greater than or substantially equal to 1.27 microns.

8. The liquid toner of claim 1 wherein said electrically-conductive functional particles have a mean particle size greater than or substantially equal to 30 microns.

9. The liquid toner of claim 1 wherein said electrically-conductive fUnctional particles are a material chosen from the group consisting of elemental metals and metal alloys.

10. The liquid toner of claim 9 wherein said elemental metal material is aluminum.

* * * * *